US012545372B1

(12) United States Patent
Xu

(10) Patent No.: US 12,545,372 B1
(45) **Date of Patent: *Feb. 10, 2026**

(54) INFLATABLE PADDLE BOARD

(71) Applicant: YOUNGER TIME PTE. LTD., Singapore (SG)

(72) Inventor: Zhongwen Xu, Shandong (CN)

(73) Assignee: YOUNGER TIME PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 19/261,972

(22) Filed: Jul. 7, 2025

(30) Foreign Application Priority Data

May 12, 2025 (CN) ..... 202510607430.8

(51) Int. Cl.

| | |
|---|---|
| ***B63B 32/51*** | (2020.01) |
| ***B63B 7/08*** | (2020.01) |
| ***B63B 32/40*** | (2020.01) |
| ***B63B 32/57*** | (2020.01) |
| ***B63B 32/59*** | (2020.01) |

(52) U.S. Cl.
CPC ..... *B63B 32/51* (2020.02); *B63B 7/08* (2013.01); *B63B 32/40* (2020.02); *B63B 32/57* (2020.02); *B63B 32/59* (2020.02)

(58) Field of Classification Search
CPC ..... B63B 32/40; B63B 32/51; B63B 32/57; B63B 32/59
See application file for complete search history.

(56) References Cited

U.S. PATENT DOCUMENTS

| | | | | |
|---|---|---|---|---|
| 11,679,845 | B2 * | 6/2023 | Clark | B63B 32/77 441/66 |
| 12,377,939 | B2 * | 8/2025 | Huang | B63B 7/08 |
| 2009/0049757 | A1 * | 2/2009 | Potter | B63B 32/51 441/74 |
| 2023/0322337 | A1 * | 10/2023 | Zeng | B63B 32/77 441/66 |
| 2024/0262465 | A1 * | 8/2024 | Liu | B63B 32/51 |

* cited by examiner

*Primary Examiner* — Ajay Vasudeva
(74) *Attorney, Agent, or Firm* — Che-Yang Chen

(57) ABSTRACT

An inflatable paddle board includes a main body and a side sealing strip which is adhered to two body layers of the main body to form an inflation chamber, wherein the side sealing strip includes two surface layers and a mesh layer between the two surface layers, each mesh layer comprises a plurality of first yarns and a plurality of second yarns which are perpendicular to each other, wherein the plurality of first yarns and the plurality of second yarns of at least a portion of the side sealing strip are respectively inclined with respect to a length direction of the side sealing strip.

20 Claims, 26 Drawing Sheets

INFLATABLE PADDLE BOARD

CROSS REFERENCE OF RELATED APPLICATION

This application is a non-provisional application that claims priority under 35U.S.C. § 119 to China application number CN2025106074308, filing date May 12, 2025, wherein the entire content of which is expressly incorporated herein by reference.

BACKGROUND OF THE PRESENT INVENTION

Field of Invention

The present invention relates to paddle board, and more particularly to an inflatable paddle board with a side sealing strip which has enhanced stretchability.

Description of Related Arts

Inflatable paddle boards are essential equipment for water surfing and other sports. They must be able to float on water while maintaining a certain level of hardness and firmness. In traditional manufacturing, paddle boards are typically made of PVC drop stitch fabrics which are bonded together by a PVC side enclosing strip using a glue.

However, the conventional PVC side enclosing strip suffers from relatively low tensile strength and limited elasticity. When subjected to tension, especially during bending or contouring, it lacks the resilience to conform snugly without deformation or wrinkling. This becomes a significant limitation when attempting to fit the strip around the varying geometry of the board body.

More specifically, the most problematic zones are the front and rear of the board, where curves or tapered angles require the strip to stretch and bend simultaneously. Due to the strip's poor tensile properties, it tends to resist these deformations, leading to buckling or gapping at corners, overlapping or misalignment of the strip, and uneven adhesive distribution, which may later cause delamination.

To overcome the strip's poor conformability, significant manual labor is needed during the assembly process to stretch, bend, position, and hold the strip in place until the adhesive sets. This labor-intensive step introduces the disadvantage that the time-consuming nature of manual adjustment slows down the overall production line. Operators must spend additional time ensuring alignment, often repeating steps to achieve acceptable conformity. As a consequence, fewer units can be completed per day, raising the cost per unit and impacting profit margins, especially in mass production scenarios.

The difficulty in achieving a tight, uniform wrap around the board body leads to inconsistencies in both appearance and structural integrity. Visible misalignments, glue overflow, wrinkles, or air bubbles can arise, diminishing the perceived quality of the final product and negatively affecting brand image. Boards produced at different times or by different operators may vary in finish quality, undermining product uniformity, an important criterion in both consumer and commercial markets. Improper adhesion or gaps at the edge strip may also reduce water-tightness or cause edge fraying over time, especially when the board is exposed to external forces during use.

The adhesion of PVC to PVC typically requires solvent-based adhesives or heat-activated bonding methods. However, the effectiveness of the bond is undermined when the strip is under tension or not fully in contact with the substrate due to imperfect conformity. Areas with insufficient contact pressure or poor alignment are prone to weak bonds, which may degrade over time due to water infiltration, temperature cycling, or mechanical stress.

In addition, paddle boards must withstand not only vertical loads but also rotational and torsional forces generated by the paddler's stance, turns, and strokes. The top and bottom body layers of the conventional paddle board may shift or shear relative to each other, leading to deformation of the board structure, especially during dynamic movements, as well as twisting or torsional instability, which negatively affects maneuverability and tracking.

SUMMARY OF THE PRESENT INVENTION

The invention is advantageous in that it provides an inflatable paddle board, wherein a mesh layer of the side sealing strip comprises inclined warp yarns and weft yarns, so that biaxial stretch and mechanical elasticity is introduced to the side sealing strip, especially in the lengthwise direction of the side sealing strip, so as to allow the side sealing strip to conform more tightly and smoothly around curved contours of a main body of the inflatable paddle board.

Another advantage of the present invention is to provide an inflatable paddle board, wherein at each of a head portion and a tail portion of the inflatable paddle board, mirrored yarn lines are integrated into the side sealing strip to reinforce both sides of each head portion or each tail portion equally. These mirrored lines create balanced mechanical support, reducing the likelihood of material distortion or buckling during edge bonding. The enclosing strip can be more evenly pressed and bonded around the edges without being pulled off-axis. It prevents asymmetrical deformation, especially important when wrapping around the tapered ends of the board.

Another advantage of the present invention is to provide an inflatable paddle board, wherein a triangular thread pattern creates a load-sharing geometry. Any downward force on the top layer is distributed via two slanted threads to the wider base of the triangle on the bottom body layer, so as to prevent point loading, reduce stress concentration at any single bottom point, ensure even distribution of compressive forces across a wider area of the bottom body layer, and help the inflatable paddle board maintain its shape under dynamic loads, such as a person shifting weight while paddling. Compared with conventional inflatable boards with vertical threads offer poor resistance to shear forces, resulting in lateral movement or "wobble" between the two body layers. The angled orientation of the two connecting threads of the present invention resists horizontal shearing and torsion. The triangle inherently provides geometric bracing, making the board more rigid under lateral stress (e.g., side waves or twisting motion from the paddler).

The present invention provides an inflatable paddle board, comprising:

a main body comprising two body layers; and a side sealing strip which is adhered to the two body layers to form an inflation chamber between the two body layers and the side sealing strip, wherein the side sealing strip comprises two surface layers and a mesh layer between the two surface layers, each mesh layer comprises a plurality of first yarns and a plurality of second yarns which are perpendicular to each other, wherein the plurality of first yarns and the plurality of second yarns of at least a part of the side sealing strip are respectively inclined with respect to a length direction of the side sealing strip.

According to an embodiment, the side sealing strip comprises one or more strip parts which are wrapped around edges of the two body layers.

According to an embodiment, the side sealing strip comprises a plurality of strip parts which are connected with each other.

According to an embodiment, an inclined angle between the first yarns and the length direction of the side sealing strip is 30°-60°.

According to an embodiment, an inclined angle between the first yarns and the length direction of the side sealing strip is 45°.

According to an embodiment, the main body comprises a head portion and a tail portion, wherein each of the head portion and the tail portion are bonded with two strip parts which have different yarn patterns.

According to an embodiment, the main body comprises a head portion and a tail portion, the first yarns of the two strip parts on two sides of each of the head portion and the tail portion are arranged in mirrored sloping lines, the second yarns of the two strip parts on two sides of each of the head portion and the tail portion are arranged in mirrored sloping lines.

According to an embodiment, the side sealing strip comprises two strip bodies wrapped around the edges of the main body, the two strip bodies have different yarn patterns.

According to an embodiment, the side sealing strip comprises two strip bodies wrapped around the edges of the main body, the first yarns of the two strip bodies on two sides of the main body are arranged in mirrored sloping lines, the second yarns of the two strip bodies on two sides of the main body are arranged in mirrored sloping lines.

According to an embodiment, the main body comprises a head portion and a tail portion, wherein the side sealing strip comprises two side sealing strip parts and two end sealing strip parts which are respectively glued to the head portion and the tail portion of the main body, wherein the plurality of first yarns and the plurality of second yarns of each end sealing strip part are respectively inclined with respect to the length direction of the side sealing strip.

According to an embodiment, the main body comprises a plurality of connecting threads connected between the two body layers, wherein a width of a main portion of the side sealing strip between edges of the two body layers is smaller than a height of the connecting threads, wherein the connecting threads between edges of the two body layers are removed or cut off in the middle.

According to an embodiment, the main body comprises a plurality of connecting threads connected between the two body layers, wherein a width of a main portion of the side sealing strip between edges of the two body layers is smaller than a height of the connecting threads between the two body layers, wherein the connecting threads between edges of the two body layers are removed or cut off in the middle.

According to an embodiment, the plurality of connecting threads form a plurality of triangular thread arrangements between the two body layers, each of the triangular thread arrangements comprises a first connecting thread and a second connecting thread, wherein the first connecting thread and the second connecting thread are connected to one of the two body layers at a same connecting point and are connected to the other of the two body layers at two different connecting points.

According to an embodiment, the plurality of connecting threads form a plurality of triangular thread arrangements between the two body layers, each of the triangular thread arrangements comprises a first connecting thread and a second connecting thread, wherein the first connecting thread and the second connecting thread are connected to one of the two body layers at a same connecting point and are connected to the other of the two body layers at two different connecting points.

According to an embodiment, a decoration strip is attached on the side sealing strip, the decoration strip comprises one or more strip parts each comprising a plurality of first yarns and a plurality of second yarns which are perpendicular to each other, wherein the first yarns and the second yarns in at least one of the strip parts are inclined yarns with respect to the length direction of the side sealing strip.

According to an embodiment, the decoration strip comprises two side strip parts and two end strip parts each connected between the two side strip parts, the first yarns and the second yarns in each end strip part are inclined yarns with respect to the length direction of the side sealing strip.

According to an embodiment, the decoration strip comprises a first decoration strip body and a second decoration strip body which are respectively attached on two opposite sides of the side sealing strip, wherein the first decoration strip body and the second decoration strip body comprise mirrored yarn patterns.

According to an embodiment, the two body layers are PVC or TPU drop stitch fabrics, wherein a plurality of connecting threads are connected between the two body layers.

According to an embodiment, each surface layer of the side sealing strip is made of PVC or TPU, the mesh layer is made of a fiber material selected from the group consisting of polyester terylene fiber, nylon and aramid fiber.

DETAILED DESCRIPTION OF THE PREFERRED EMBODIMENT

Figure 1:
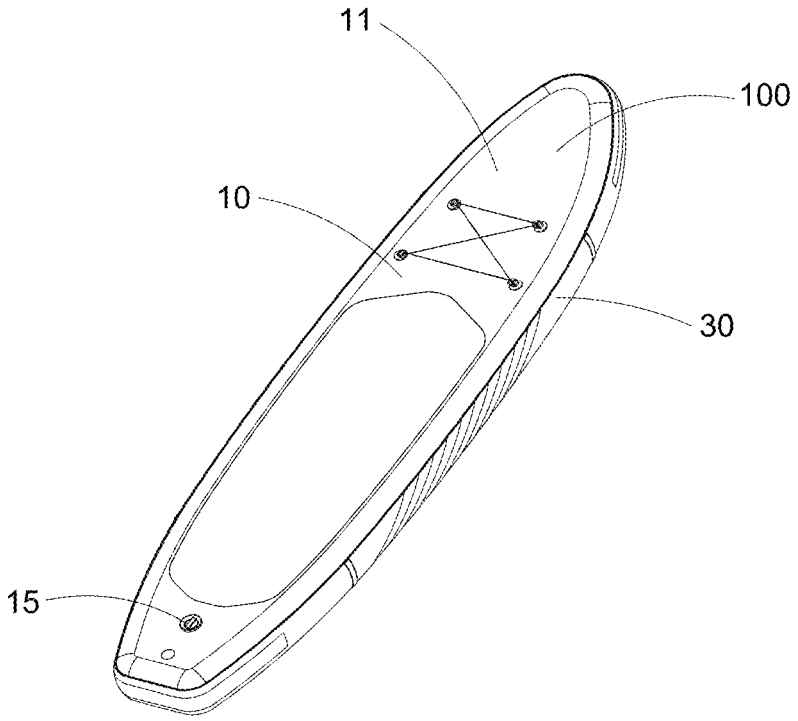
FIG. 1 is a perspective view of an inflatable paddle board according to a preferred embodiment of the present invention.
Figure 2:
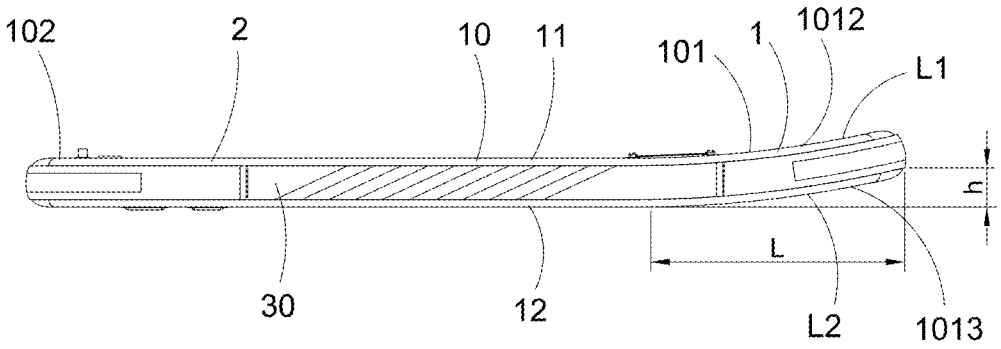
FIG. 2 is a side view of the inflatable paddle board according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 20 of the drawings, an inflatable paddle board 100 according to a preferred embodiment of the present invention is illustrated. The inflatable board 100 comprises a main body 10 comprising two body layers which can be a top body layer 11 and a bottom body layer 12, and a plurality of connecting threads 13 extended between the two body layers 11 and 12, a side sealing strip 20 adhered to edges 110 and 120 of the two body layers 11 and 12 respectively to define an inflation chamber 14 between the two body layers and the side sealing strip 20, and an inflation valve 15 for inflating the inflation chamber 14.

In this embodiment, connecting threads 13 at the edges 110 and 120 of the two body layers 11 and 12 can be eliminated or cut off in the middle, areas within the edges 110 and 120 of the two body layers 11 and 12 are provided with the connecting threads 13, so as to facilitate the adhering between the side sealing strip 20 and the edges 110 and 120 of the two body layers 11 and 12.

In addition, when the inflatable paddle board 100 is inflated, the edges 110 and 120 of the two body layers 11 and 12 can be bent to form a portion of the side wall of the inflatable paddle board 100. The side sealing strip 20 comprises a main portion 2031 and two edge portions 2032 extended from two sides of the main portion 2031. A width of the main portion 2031 can be smaller than a height of the connecting threads 13.

Cutting or omitting the connecting threads 13 at the edges 110 and 120 removes the risk of frayed thread ends protruding at the sealing interface, prevents stress concentrations at the very edge where the connecting threads 13 meet the bonded side sealing strip 20, which could lead to premature material fatigue or peeling, and permits freer deformation, allowing the edges 110 and 120 to wrap naturally around the contour of the inflatable paddle board 100, so as to produce a clean, curved transition from the deck surface to the sidewall, reduces resistance during inflation, which might otherwise be caused by tensioned vertical threads.

The two body layers 11 and 12 serve as the top and bottom structural layers of the board. Between these two body layers 11 and 12, a plurality of the connecting threads 13 are arranged. These connecting threads 13 are extended between the top and bottom body layers 11 and 12, and are essential for maintaining the shape and structural integrity of the inflatable paddle board 100 when inflated. Actually, the connecting threads 13 help the board resist excessive expansion and deformation, ensuring that it maintains a rigid and flat surface similar to a solid board when fully inflated.

Figure 5A:
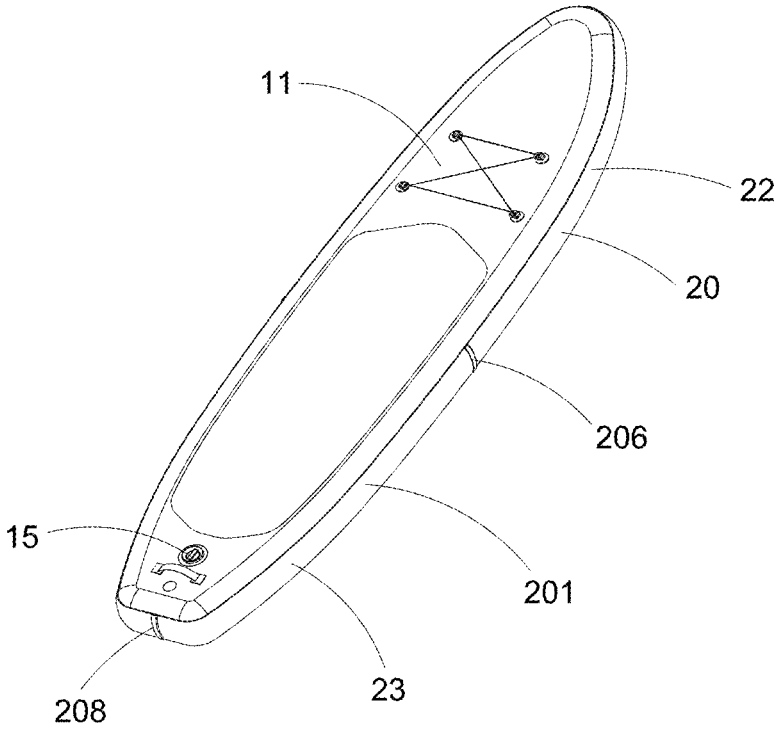
FIG. 5A is a perspective view of the inflatable paddle board according to the above preferred embodiment of the present invention, wherein the decoration strip has not been attached to the side sealing strip.
Figure 5B:
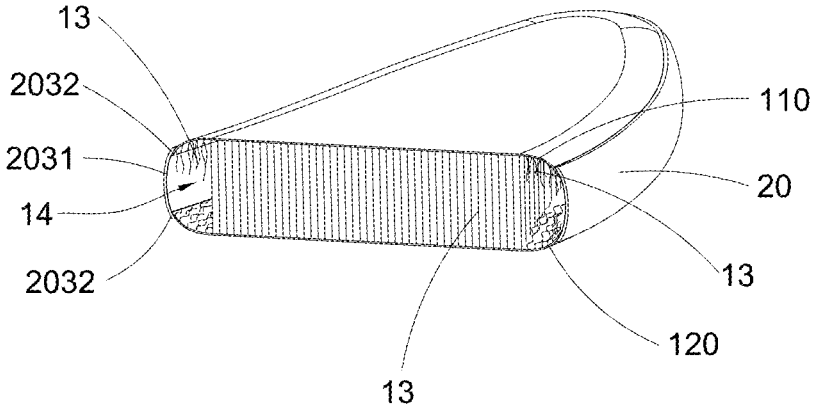
FIG. 5B is a cross-sectional view of the inflatable paddle board in FIG. 5A.
Figure 5C:
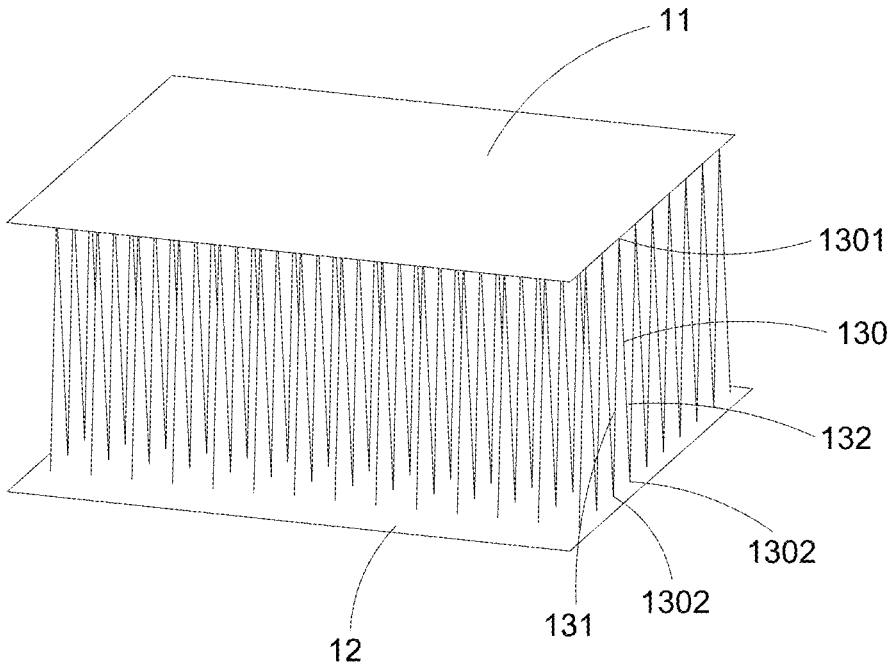
FIG. 5C is a schematic view illustrating the connecting threads between two body layers of the main body of the inflatable paddle board according to the above preferred embodiment of the present invention.

As shown in FIG. 5C, the plurality of connecting threads 13 form a plurality set of triangular thread arrangement 130 created by having a single top connecting point 1031 on the top body layer 11 correspond to two distinct bottom connecting points 1302 on the bottom body layer 12. These three points are connected using two separate connecting threads which are a first connecting thread 131 and a second connecting thread 132, forming a triangular configuration within the inflation chamber 14. When the inflation chamber 14 is inflated, both of the two threads 131 and 132 can be inclinedly extended between the two body layers 11 and 12, or the first connecting thread 131 is inclinedly extended between the two body layers 11 and 12 while the second second connecting thread 132 is vertical between the two body layers 11 and 12. This is in contrast to conventional drop-stitch structures that typically use one-to-one vertical thread connections between the top and bottom layers.

This triangular configuration provides several distinct mechanical, structural, and performance-related advantages. The triangular thread pattern creates a load-sharing geometry. Any downward force on the top body layer 11 is distributed via two slanted threads to the wider base of the triangle on the bottom body layer 12, so that it is able to prevent point loading, reducing stress concentration at any single bottom point, ensure an even distribution of compressive forces across a wider area of the bottom body layer 12, and helps the inflatable paddle board 100 maintain its shape under dynamic loads, such as a person shifting weight while paddling.

In conventional inflatable boards, vertical threads offer poor resistance to shear forces, resulting in lateral movement or wobble between the two body layers 11 and 12. The angled orientation of the two connecting threads 131 and 132 resists horizontal shearing and torsion. The triangle inherently provides geometric bracing, making the inflatable paddle board 100 more rigid under lateral stress (e.g., side waves or twisting motion from the paddler).

In addition, over time and with repeated use, the repeated inflation-deflation cycle may cause elongation or misalignment in vertical threads, leading to surface warping or bulging. The oblique threads of the present invention act as stabilizing tension members, reducing elongation under pressure, maintaining consistent thickness of the inflation chamber 14, minimizing the risk of bulging or warping even under prolonged high pressure.

The side sealing strip 20 is adhered to the edges 110 and 120 of the two body layers 11 and 12, sealing the perimeter of the inflatable paddle board 100. The inflation chamber 14 is the enclosed space that fills with air when the inflatable paddle board 100 is inflated. By controlling the air pressure within the inflation chamber 14, the rigidity of the inflatable paddle board 100 can be adjusted to suit different water conditions and user preferences.

When fully inflated, the combination of the two body layers 11 and 12, the connecting threads 13, and the side sealing strip 20 ensures that the inflatable paddle board 100 retains its shape and provides a stable platform for paddling.

At the heart of the inflatable paddle board 100 lies the drop stitch fabric, a material pivotal to the structural integrity of the inflatable paddle board 100. The two body layers 11 and 12 are two parallel layers of drop stitch fabric material connected by the plurality of connecting threads 13 which can be made of olyester terylene fiber, nylon or aramid fiber. When the inflatable paddle board 100 is inflated, these connecting threads 13 hold the top and bottom surfaces together, maintaining a flat shape and allowing the inflatable paddle board 100 to achieve high internal pressure, resulting in a firm and stable platform.

The primary material enveloping the drop stitch core is typically polyvinyl chloride (PVC). Known for its durability and resistance to abrasions, PVC ensures that the inflatable paddle board 100 remains airtight and resilient against environmental factors. In some cases, thermoplastic polyurethane (TPU) is used as an alternative coating, offering similar airtight properties. Inside the PVC or TPU layers, a mesh layer can be provided.

The side sealing strip 20 is typically mainly made of a strong and flexible material, such as PVC or TPU, providing resistance against air leakage, external impacts, and general wear and tear.

More specifically, as shown in FIGS. 8-12, the side sealing strip 20 of this embodiment comprises two surface layers 201 and a mesh layer 202 disposed between the two surface layers 201. Each of the two surface layers 201 can be made of PVC or TPU, the mesh layer 202 can be made of a fiber material such as polyester terylene fiber, nylon and aramid fiber. The mesh layer 202 comprises a plurality of first yarns 2021 and a plurality of second yarns 2022 which are vertical to each other and are connected to define a plurality of connecting nodes 2023, the two surface layers 201 are coated on two sides of the mesh layer 202. The first yarns 2021 and the second yarns 2022 can be respectively embodied as warp yarns and weft yarns.

The fiber-reinforced mesh layer 202 increases tensile strength, preventing shape distortion when inflated. The PVC or TPU-coated surface layers 201 offer resistance to environmental stress, impacts, and abrasions, extending the board's lifespan. The double-layered coating structure ensures a tight seal, reducing the risk of air leakage over time. The warp and second yarns 2021, 2022 in the mesh layer control expansion, ensuring a stable shape and firm surface when fully inflated.

Figure 16:
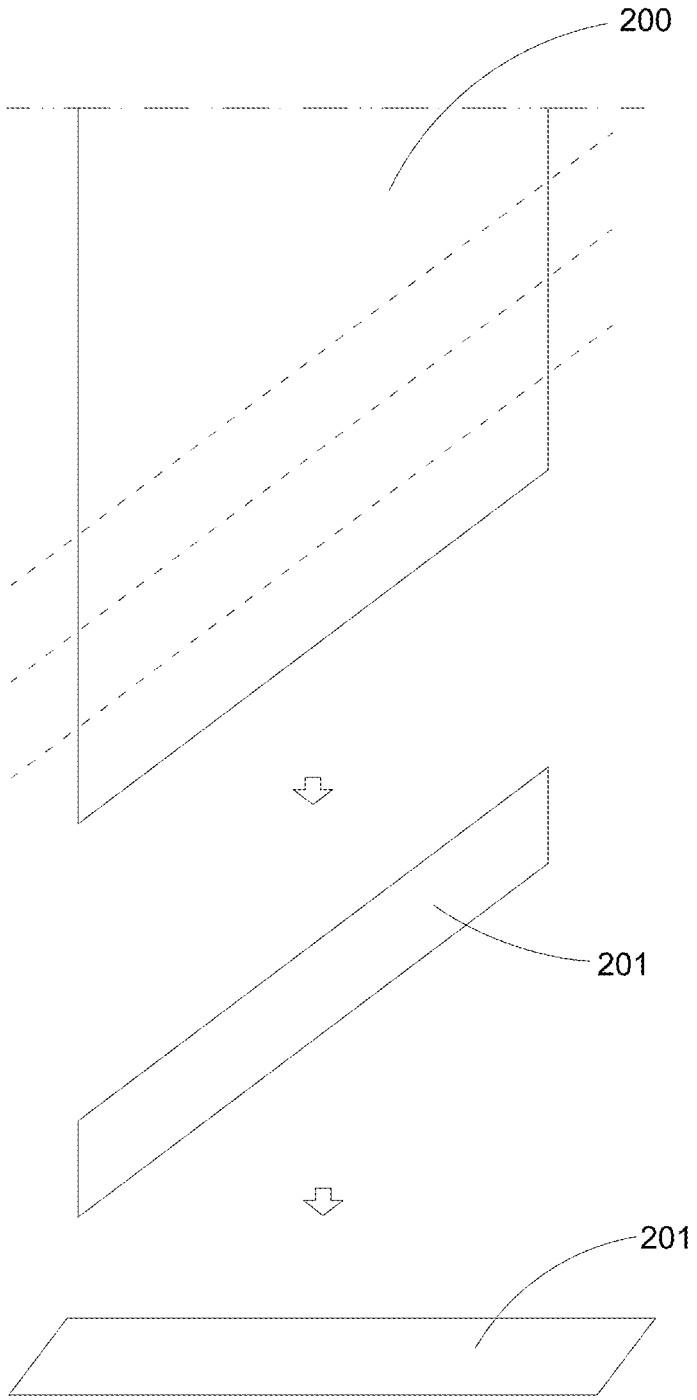
FIG. 16 is a schematic view illustrating a strip material being cut to form the strip part of the side sealing strip of the inflatable paddle board according to the above preferred embodiment of the present invention.
Figure 17:
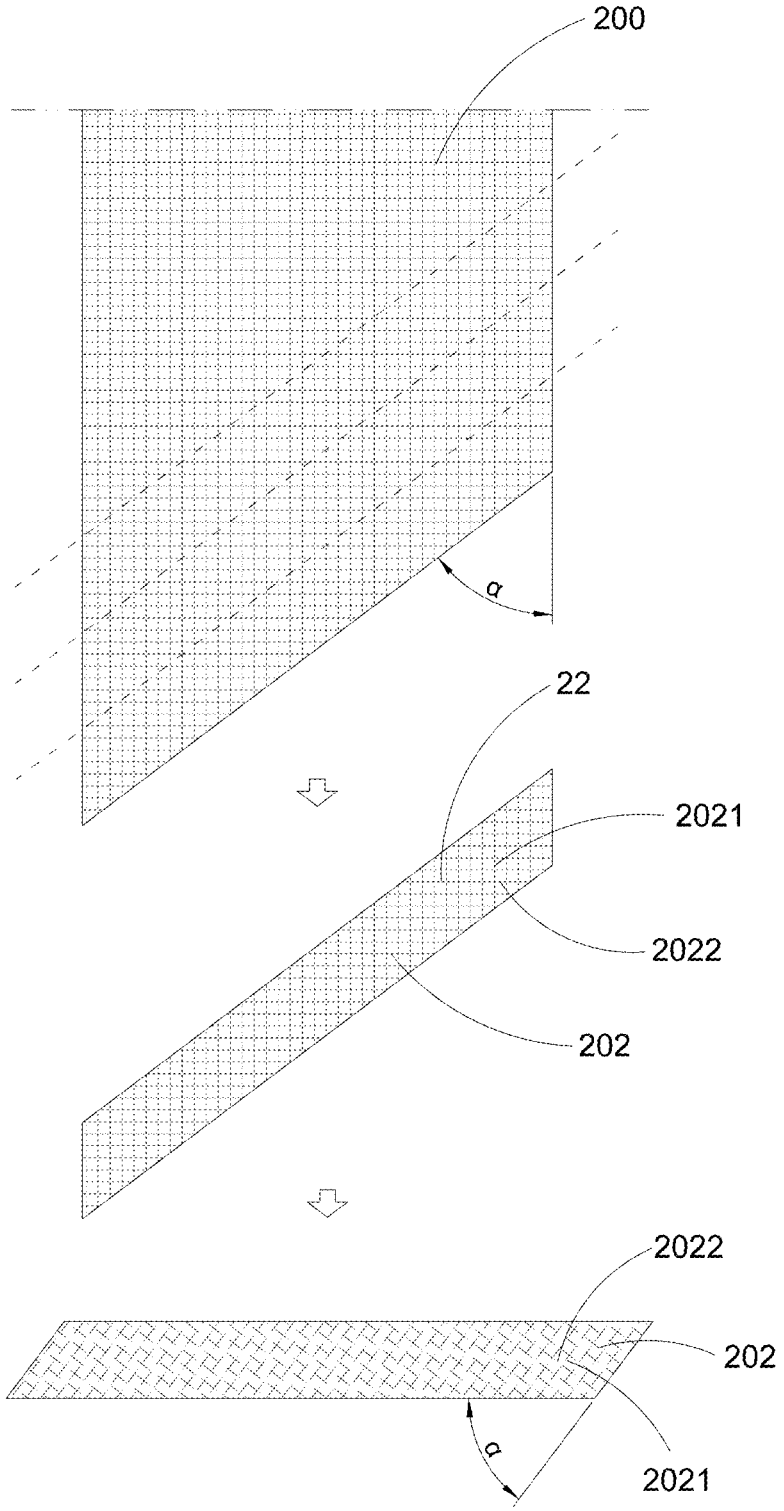
FIG. 17 is a schematic view illustrating the mesh layer of the strip part of the side sealing strip of the inflatable paddle board according to the above preferred embodiment of the present invention, wherein a top surface layer above the mesh layer is removed for showing the mesh layer of the obtained strip part.

Referring to FIG. 16 and FIG. 17 of the drawings, a strip material 200 is illustrated to comprise horizontal first yarns 2021 and vertical second yarns 2022 which are perpendicular to each other. The horizontal first yarns 2021 can be extended along the length direction of the strip material 200 while the vertical second yarns 2022 can be extended along a width direction of the strip material 200. When the material sheet for the side sealing strip 20 is cut off from the strip material 200, it is preferred in this embodiment that the cutting line is an incline cutting line with respect to the horizontal first yarns 2021, but is not along the horizontal first yarns 2021. The advantages of inclined cutting are to prevent fraying, allow for different desired lengths, and provide elasticity and stretchability.

As shown in FIG. 17 of the drawings, the first yarns 2021 and the second yarns 2022 are respectively not extended in the length direction of the side sealing strip 20 and the width direction of the side sealing strip 20, so as to enhance stretchability along the length direction of the side sealing strip 20, so that the side sealing strip 20 is able to circumferentially wrapped around and adhered on the edge 110 of the top body layer 11 and the edge 120 of the bottom body layer 12. An included angle $\alpha$ between the first yarns 2021 and the length direction of the side sealing strip 20 is 30°-60°, preferred 37°-53°, more preferred 45°.

In other words, when cut along the first yarns, the obtained side sealing strip 20 would have rigid fibers aligned along its length, limiting flexibility. Inclined cutting disrupts the rigid fiber alignment, increasing stretchability in the length direction. This stretchability allows the side sealing strip 20 to stretch and conform smoothly when wrapped around the edge 110 of the top body layer 11 and the edge 120 of the bottom body layer 12, the configuration also reduces stress concentration, preventing wrinkles, deformation, or misalignment in the wrapping process. With better stretchability, the side sealing strip 20 evenly conforms to the curved edges of the main body 10, ensuring a larger and more consistent contact surface for glue bonding, so that a secure and airtight seam is formed, preventing air leakage and improving durability.

In addition, when adhering the side sealing strip 20 to the main body 10, pressing forces will act on the side sealing strip 20 at two sides thereof, the inclined fiber orientation absorbs and distributes stress more effectively, so as to prevent wrinkles and enhance better conformation to the contour of the main body 10.

Figure 10:
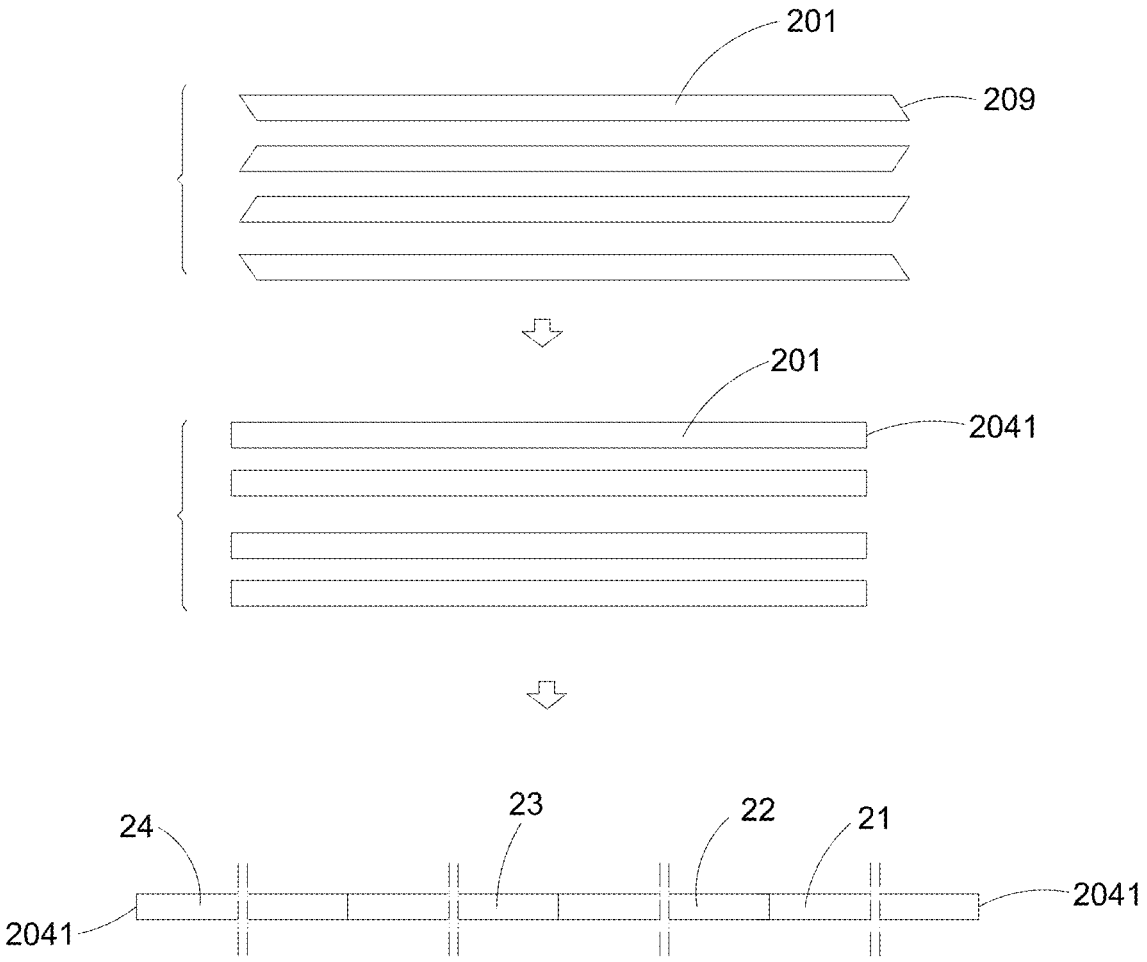
FIG. 10 is a schematic view illustrating four strip parts being connected to form the side sealing strip of the inflatable paddle board according to the above preferred embodiment of the present invention.
Figure 11:
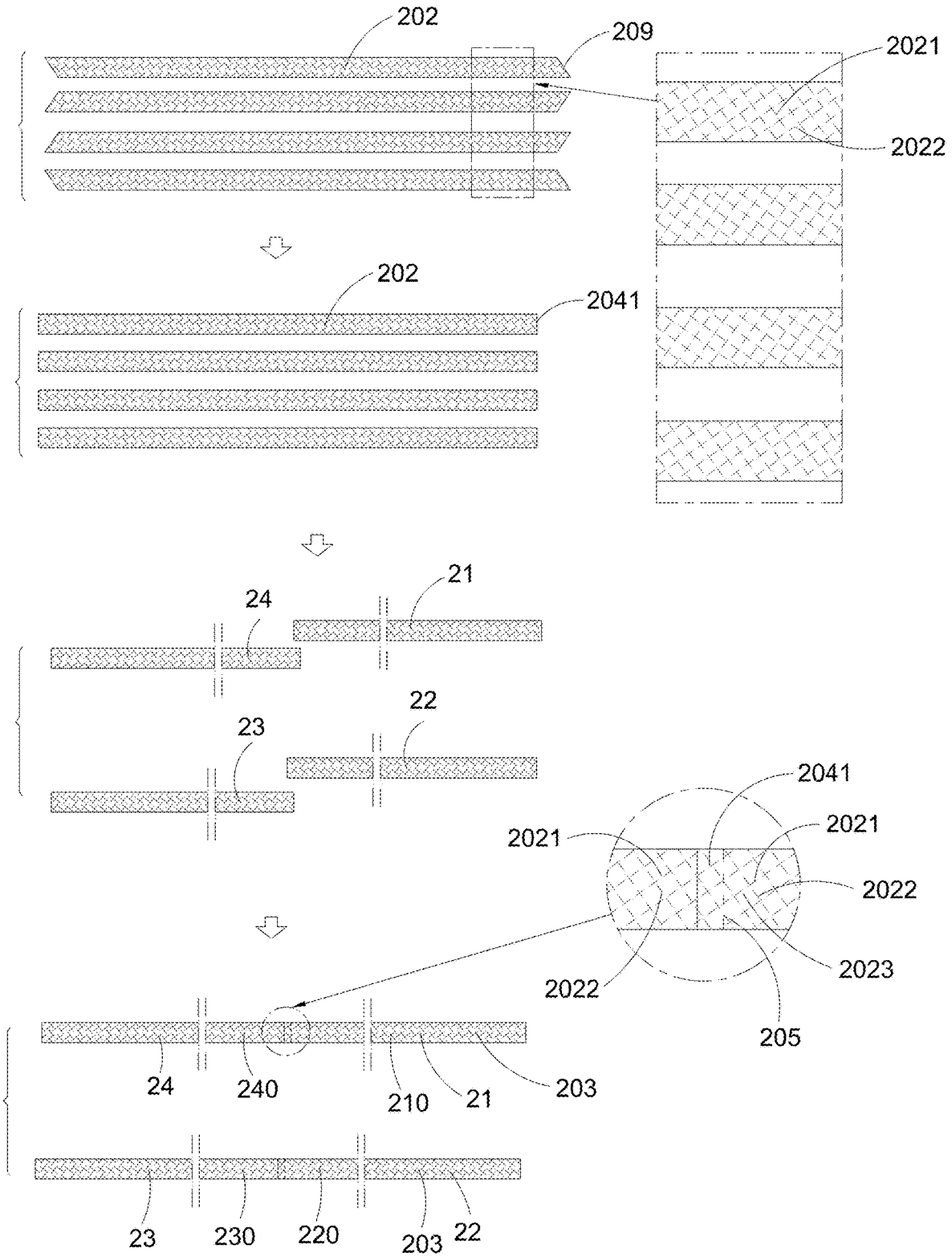
FIG. 11 is a schematic view illustrating yarn patterns of the strip parts of the side sealing strip of the inflatable paddle board according to the above preferred embodiment of the present invention, wherein a top surface layer above the mesh layer is removed for showing the mesh layer of each strip part.
Figure 12:
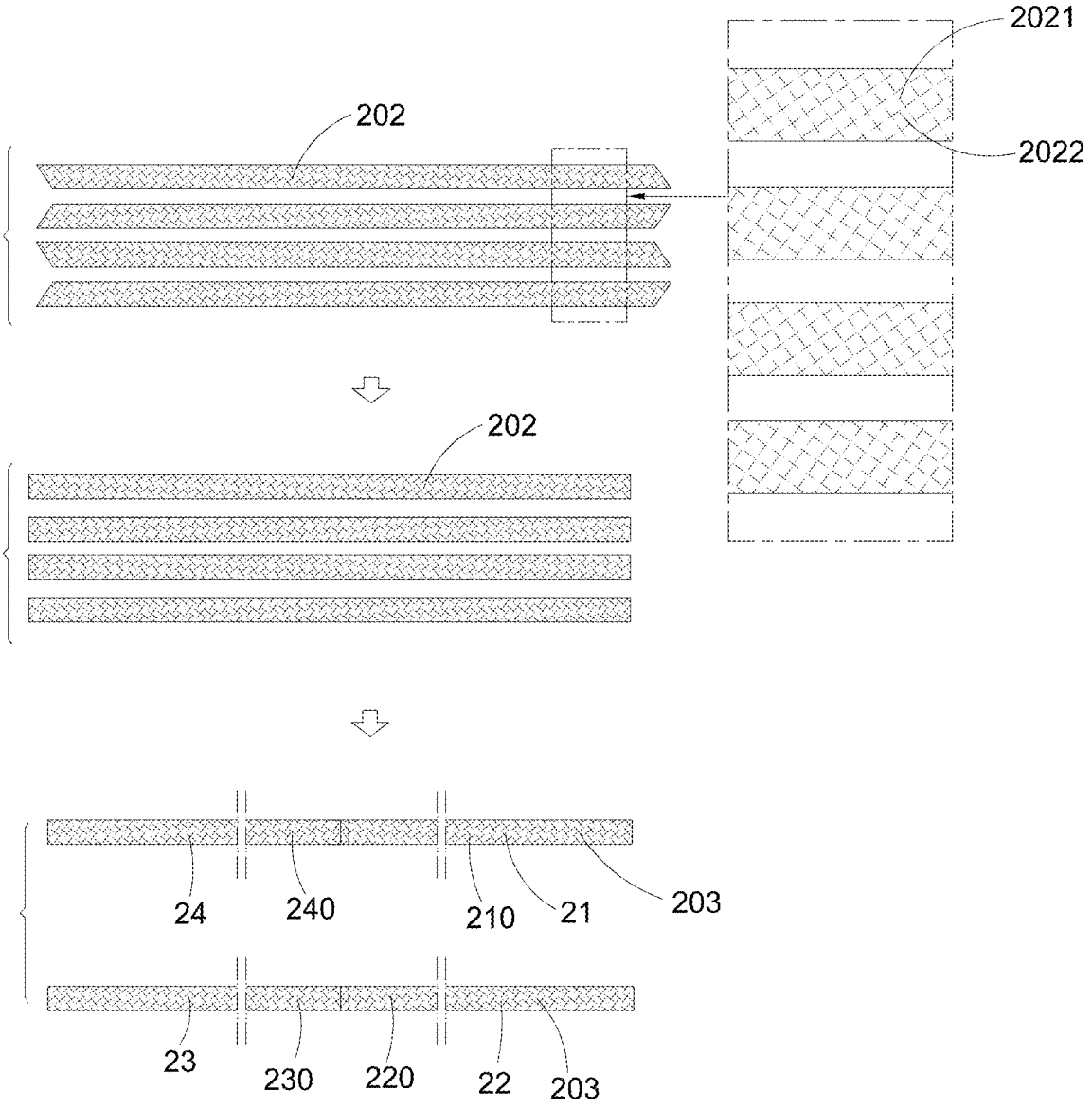
FIG. 12 is a schematic view illustrating alternative yarn patterns of the strip parts of the side sealing strip of the inflatable paddle board according to the above preferred embodiment of the present invention, wherein a top surface layer above the mesh layer is removed for showing the mesh layer of each strip part.

The side sealing strip 20 can be embodied as a single strip. As shown in FIG. 10 to FIG. 12 of the drawings, the side sealing strip 20 comprises a plurality of strip parts which are connected in an end-to-end manner to form a ring-shaped strip for coupling with the edge 110 of the top body layer 11 and the edge 120 of the bottom body layer 12 by glue bonding.

More specifically, in this embodiment, the side sealing strip 20 comprises four strip parts which are a first strip part 21, a second strip part 22, a third strip part 23 and a fourth strop part 24. The four strip parts are integrated with each other to form two strip bodies 203 which are provided at two opposite sides of the main body 10.

Before the glue bonding process of the side sealing strip 20, the first strip part 21 is adhered with the fourth strip part 24 by a first connecting seam 205 to form a first strip body, the second strip part 22 is adhered with the third strip part 23 by a second connecting seam 206 to form a second strip body. In the glue bonding process, the two strip bodies 203 are adhered with each other by a third connecting seam 207 and a fourth connecting seam 208 at two sides thereof. A length of each strip part can be 1 m-2.5 m, preferred 1.6 m-2.2 m, a width of each strip part can be 5 cm-25 cm, preferred 8 cm-13 cm, a thickness of each strip part can be 0.3 cm-1 cm, preferred 0.5 cm-0.7 cm. The width of the main portion 2031 of each strip part between edges of the main body 10 is shorter than a height of the connecting threads 13 which can be 15 cm, because that the connecting threads 13 between edges 110 and 120 of the two body layers are removed or cut off in the middle, the edges 110 and 120 of the two body layers can function as parts of the side wall of the inflatable paddle board 100. A width of each of the edge 110 of the top body layer 11 and the edge 120 of the bottom body layer 12 which are respectively bonded with the strip parts of the peripheral enclosing strip 20 is about 0.5 cm-3 cm, preferred 1.5 cm-2 cm.

As a typical example, a length of each strip part for a common inflatable paddle board 100 can be 1.8 m, a width of each strip part can be 8 cm, a thickness of each strip part can be 0.52 cm, a height of the connecting threads can be 15 cm.

The main body 10 of the inflatable paddle board comprises a head portion 101 and a tail portion 102, the first strip part 21 and the second strip part 22 are distributed at two sides of the head portion 101 while the third strip part 23 and the fourth strip part 24 are distributed at two sides of the tail portion 102. Each of the first strip part 21, the second strip part 22, the third strip part 23 and the fourth strip part 24 comprises the first yarns 2021 and the second yarns 2022 between two surface layers 201. The first yarns 2021 and the second yarns 2022 of the first strip part 21 defines a first yarn pattern 210, the first yarns 2021 and the second yarns 2022 of the second strip part 22 defines a second yarn pattern 220, the first yarns 2021 and the second yarns 2022 of the third strip part 23 defines a third yarn pattern 230, the first yarns 2021 and the second yarns 2022 of the fourth strip part 24 defines a fourth yarn pattern 240. As shown in FIGS. 11 and 12 of the drawings, the first yarn pattern 210 is different from the second yarn pattern 220, the third yarn pattern 230 is different from the fourth yarn pattern 240. The first and second yarns in different strip parts intersect at varied angles, allowing each part to conform better to curved or bent edges of the head or tail portion of the main body 10.

More specifically, both the first yarns 2021 and the second yarns 2022 of each strip part are inclined with respect to the length direction of the side sealing strip 20 along the peripheral edge of the main body 10. The first strip part 21 and the second strip part 22 wrapped around the head portion 101 of the main body 10 are not formed by a continual strip which is folded to provide two parts which are laminated on the head portion 101 of the main body 10. The first yarns 2021 of the first strip part 21 are not parallel with the first yarns 2021 of the second strip part 22, but define an included angle thereof which can be an acute angle, the second yarns 2022 of the first strip part 21 are also not parallel with the second yarns 2022 of the second strip part 22, but define an included angle therebetween which can be an acute angle. The first yarns 2021 of the first strip part 21 and the first yarns 2021 of the second strip part 22 can be arranged in mirrored sloping lines, the second yarns 2022 of the first strip part 21 and the second yarns 2022 of the second strip part 22 can be arranged in mirrored sloping lines. In the mirrored sloping lines, one line slopes upward from left to right, while the other slope downward from left to right, creating a balanced and reflective geometric appearance.

The mirrored sloping lines can be symmetrical or not symmetrical. Preferably, the first yarn pattern 210 of the first strip part 21 is symmetrical to the second yarn pattern 220 of the second strip part 22, the first yarns 2021 of the first strip part 21 are symmetrical with the first yarns 2021 of the second strip part 22 on two sides of the third connecting seam 207 between the first strip part 21 and the second strip part 22.

During glue bonding, unlike a continual strip with horizontal yarns and vertical yarns which will result in that the stress will be distributed along a bending edge 1011 of the head portion 101 of the main body 10 to produce wrinkles and weak bonding, the first strip part 21 and the second strip part 22 of this embodiment of the present invention will conform to the bending edge 1011 the head portion 101 of the main body 10.

The third strip part 23 and the fourth strip part 24 wrapped around the tail portion 102 of the main body 10 are not formed by a continual strip which is folded to provide two parts which are laminated on the tail portion 102 of the main body 10. The first yarns 2021 of the third strip part 23 are not parallel with the first yarns 2021 of the fourth strip part 24, but define an included angle thereof which can be an acute angle, the second yarns 2022 of the third strip part 23 are also not parallel with the second yarns 2022 of the fourth strip part 22, but define an included angle therebetween which can be an acute angle. The first yarns 2021 of the third strip part 23 and the first yarns 2021 of the fourth strip part 24 can be arranged in mirrored sloping lines, the second yarns 2022 of the third strip part 23 and the second yarns 2022 of the fourth strip part 24 can be arranged in mirrored sloping lines. in the mirrored sloping lines, one line slopes upward from left to right, while the other slope downward in the same manner, creating a balanced and reflective geometric appearance.

Preferably, the third yarn pattern 230 of the third strip part 23 is symmetrical to the fourth yarn pattern 240 of the fourth strip part 24, the first yarns 2021 of the third strip part 23 are symmetrical with the first yarns 2021 of the fourth strip part 24 on two sides of a fourth connecting seam 208 between the third strip part 23 and the fourth strip part 24.

During glue bonding, unlike a continual strip with horizontal yarns and vertical yearns which will result in that the stress will distribute along a bending edge 1021 of the tail portion 102 of the main body 10 to produce wrinkles and weak bonding, the third strip part 23 and the fourth strip part 24 of this embodiment of the present invention will conform to the bending edge 1021 of the tail portion 102 of the main body 10.

As shown in FIG. 11, the first strip body comprising the first strip part 21 and the fourth strip part 24 may have a same yarn pattern, the second strip body comprising the second strip part 22 and the third strip part 23 may have a same yarn pattern. As shown in FIG. 12, the first strip part 21 and the fourth strip part 24 may have different yarn patterns, the second strip part 22 and the third strip part 23 may have different yarn patterns.

Referring to FIG. 17, when the strip material 200 is inclined cut to provide the strip parts of the side sealing strip 20 of the present invention. In the present invention, two strip materials can be cut from the same strip material 200, one of the strip materials is flipped, so as to allow the two strip materials to provide the strip parts with different yarn patterns, such as the first strip part 21 and the second strip part 22. Alternatively, the inclined cutting lines on two different strip materials 200 are mirror cutting lines, so as to provide the strip parts with different yarn patterns.

Figure 6:
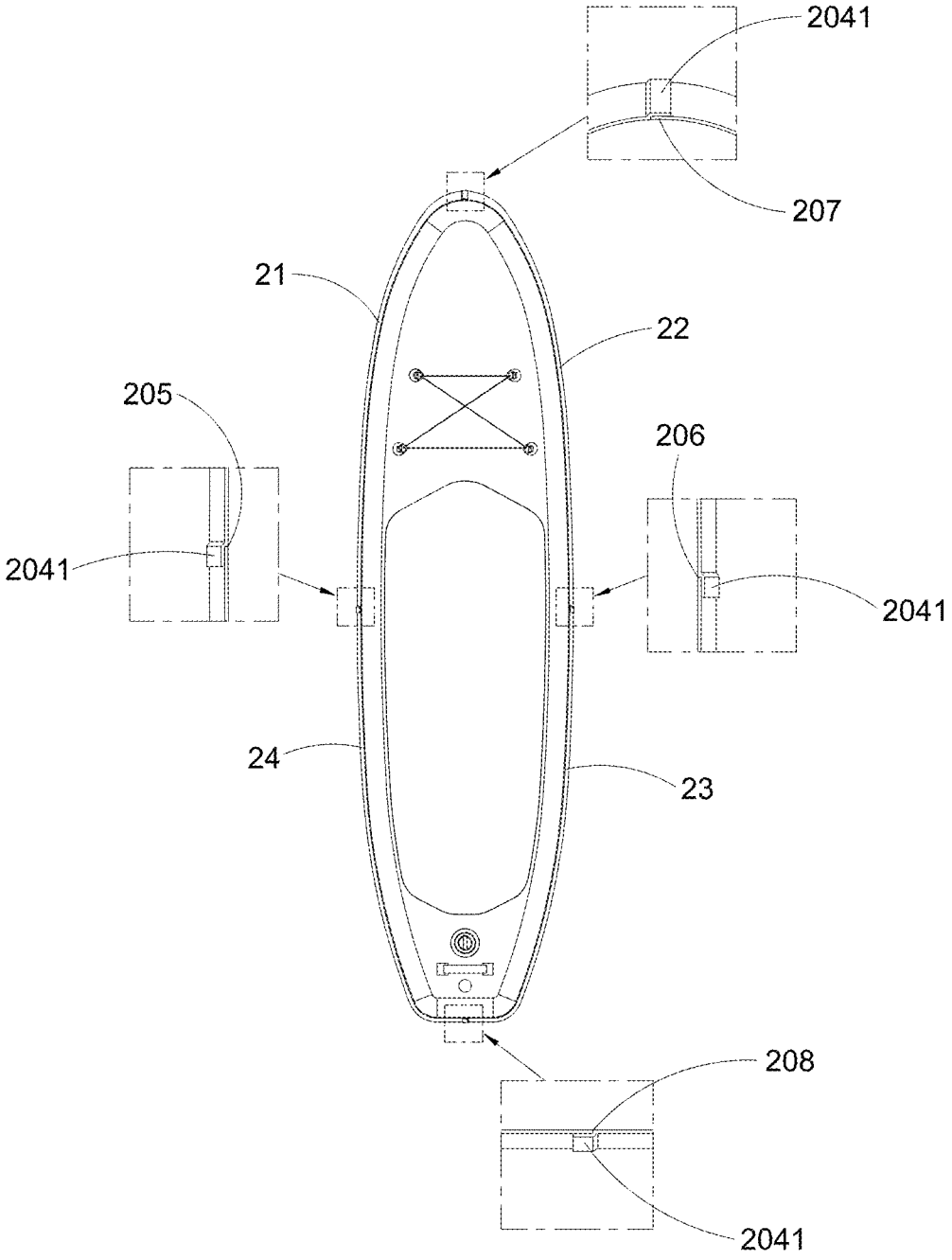
FIG. 6 is a schematic view illustrating a plurality of strip parts of the side sealing strip of the inflatable paddle board according to the above preferred embodiment of the present invention.
Figure 7:
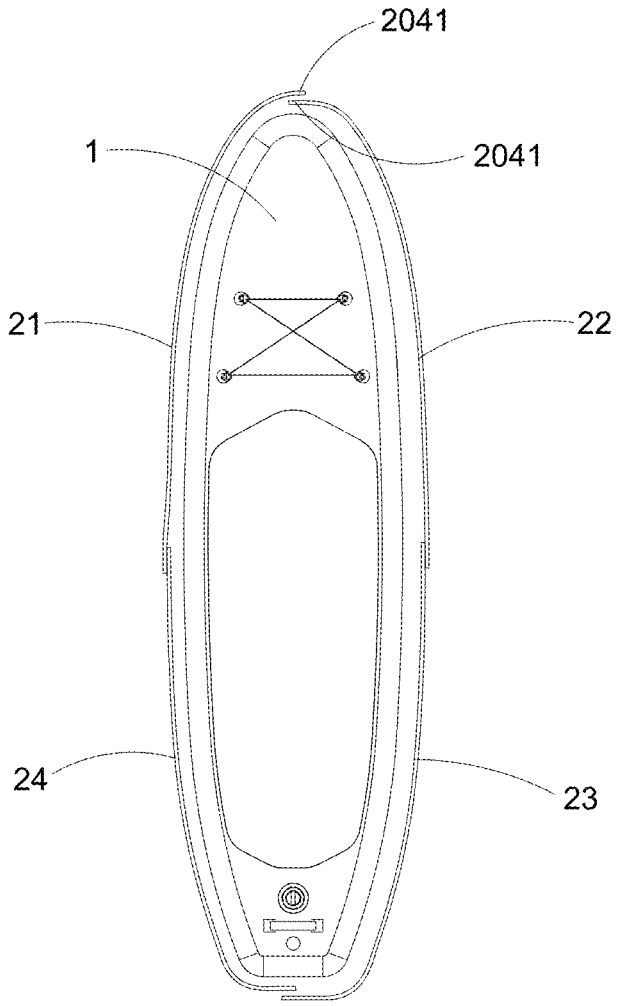
FIG. 7 is a schematic view illustrating a layering pattern between end edges of adjacent strip parts of the plurality of strip parts of the side sealing strip of the inflatable paddle board according to the above preferred embodiment of the present invention.
Figure 8:
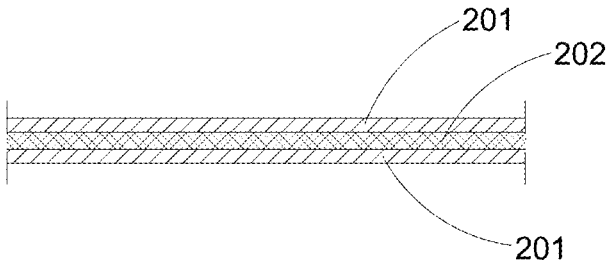
FIG. 8 is a sectional view illustrating the side sealing strip of the inflatable paddle board according to the above preferred embodiment of the present invention.
Figure 9:
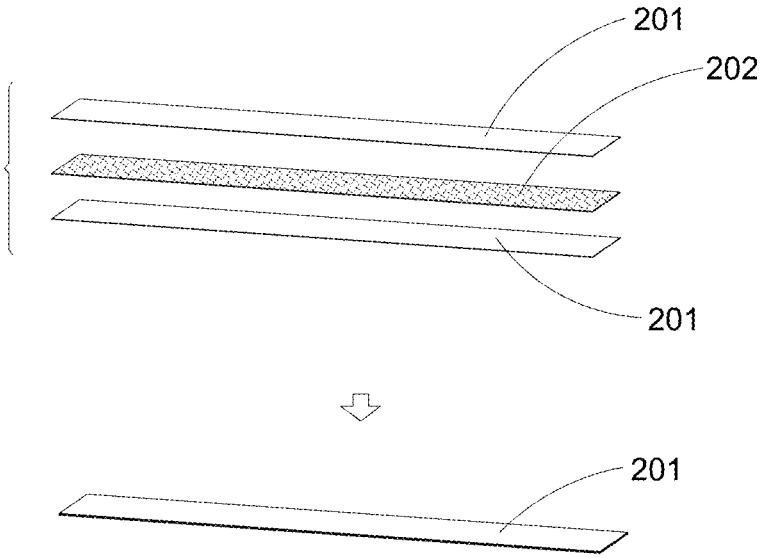
FIG. 9 is a schematic view illustrating the stacking of two surface layers and a mesh layer of the side sealing strip of the inflatable paddle board according to the above preferred embodiment of the present invention.

As shown in FIGS. 6 and 7, it is worth mentioning that the third connecting seam 207 is preferred to be positioned at a center of the bending edge 1011 of the head portion 101, the fourth connecting seam 208 is preferred to be positioned at a center of the bending edge 1021 of the tail portion 102. Alternatively, the third connecting seam 207 may be positioned away from the center of the bending edge 1011 of the head portion 101 with an allowable deviation within 10 cm, the fourth connecting seam 208 may be positioned away from the center of the bending edge 1021 of the tail portion 102 with an allowable deviation within 10 cm. Each of the first connecting seam 205 and the second connecting seam 206 is respectively preferred to be positioned at a central area of the side edge of the main body 10.

As shown in FIGS. 10 to 12 of the drawings, when the strip part of the side sealing strip 20 is cut off from the strip material 200, the strip part of the side sealing strip 20 is provided with two end edges 209 which are inclined edges. The end portions with the inclined edges 209 are then cut off so as to provide the strip part with two vertical end edges 2041, so that two strip parts with vertical end edges 2041 are easy to be aligned and overlapped with each other for glue bonding.

Figure 3A:
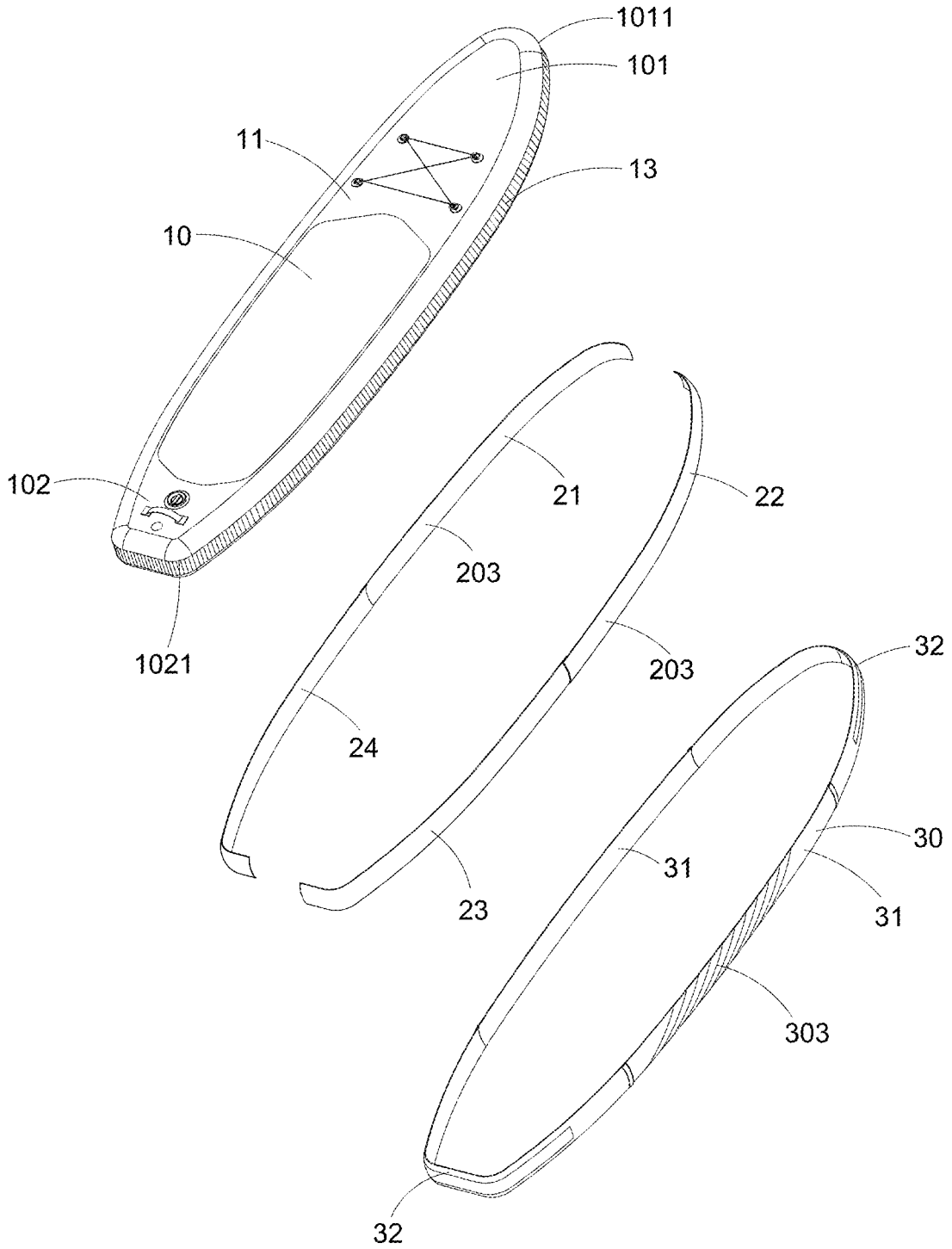
FIG. 3A is an exploded view of the inflatable paddle board according to the above preferred embodiment of the present invention.
Figure 3B:
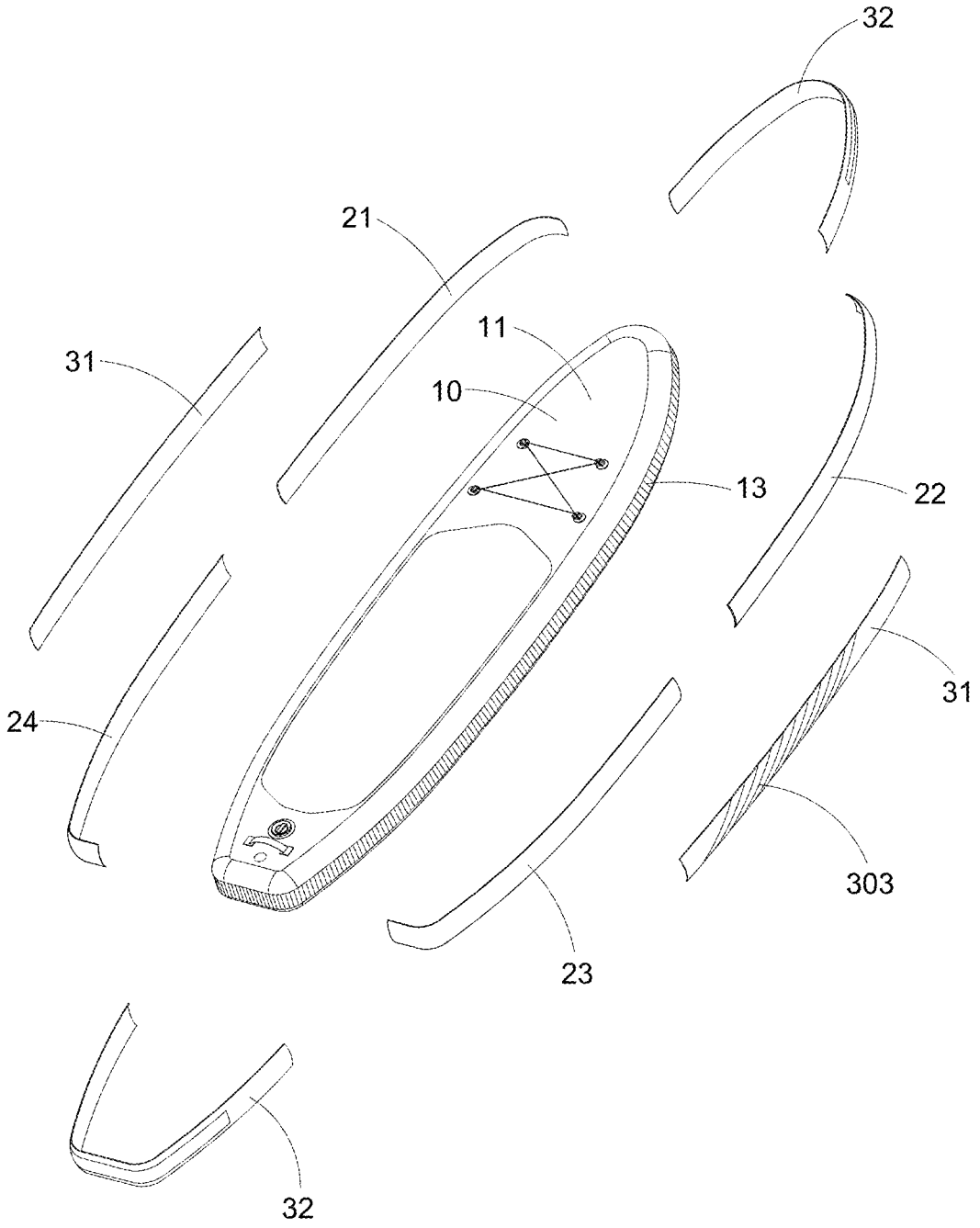
FIG. 3B is a further exploded view illustrating a side sealing strip and a decoration strip of the inflatable paddle board according to the above preferred embodiment of the present invention.
Figure 3C:
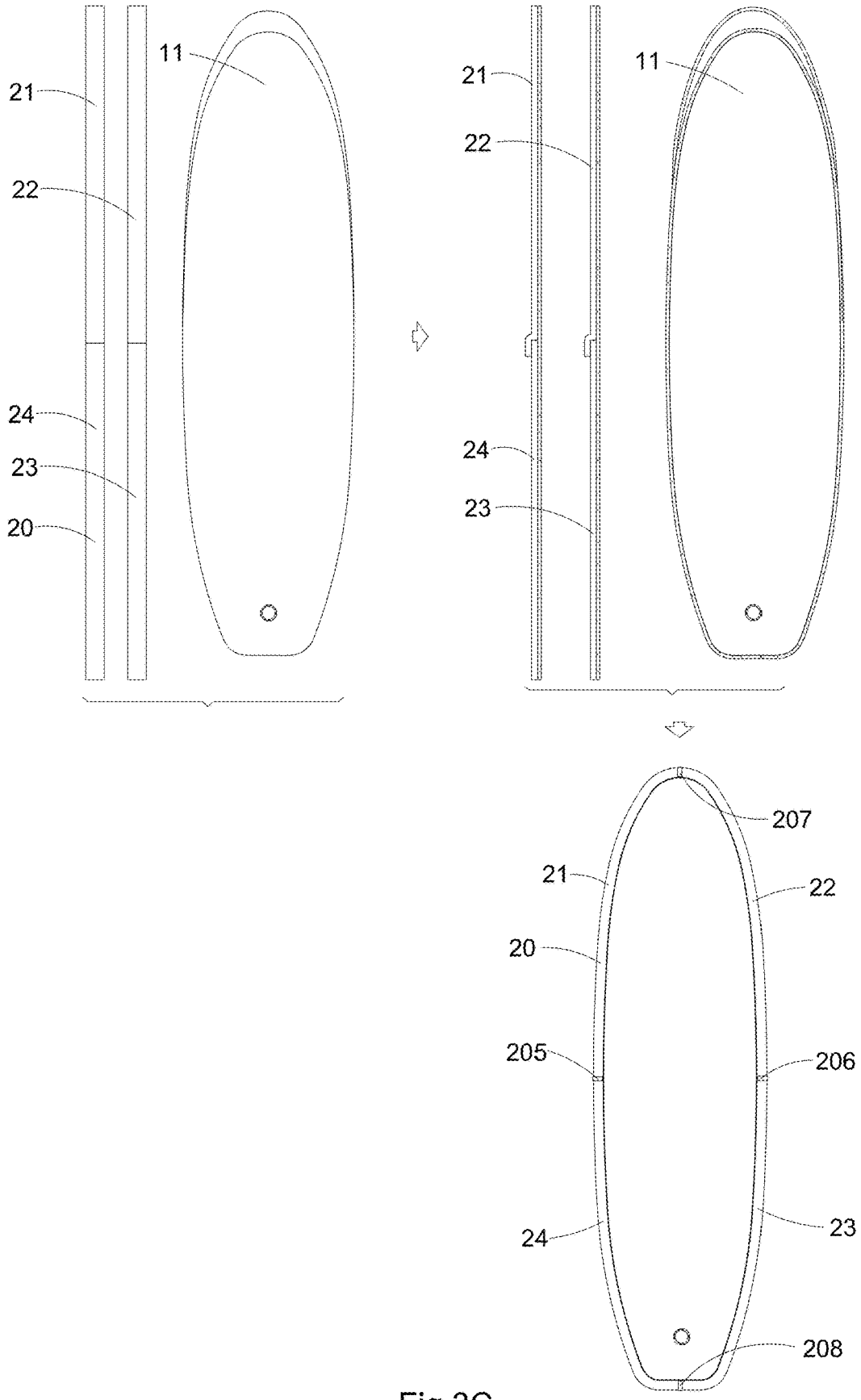
FIG. 3C is a schematic view illustrating the process of attaching the side sealing strip to a main body of the inflatable paddle board according to the above preferred embodiment of the present invention.
Figure 3D:
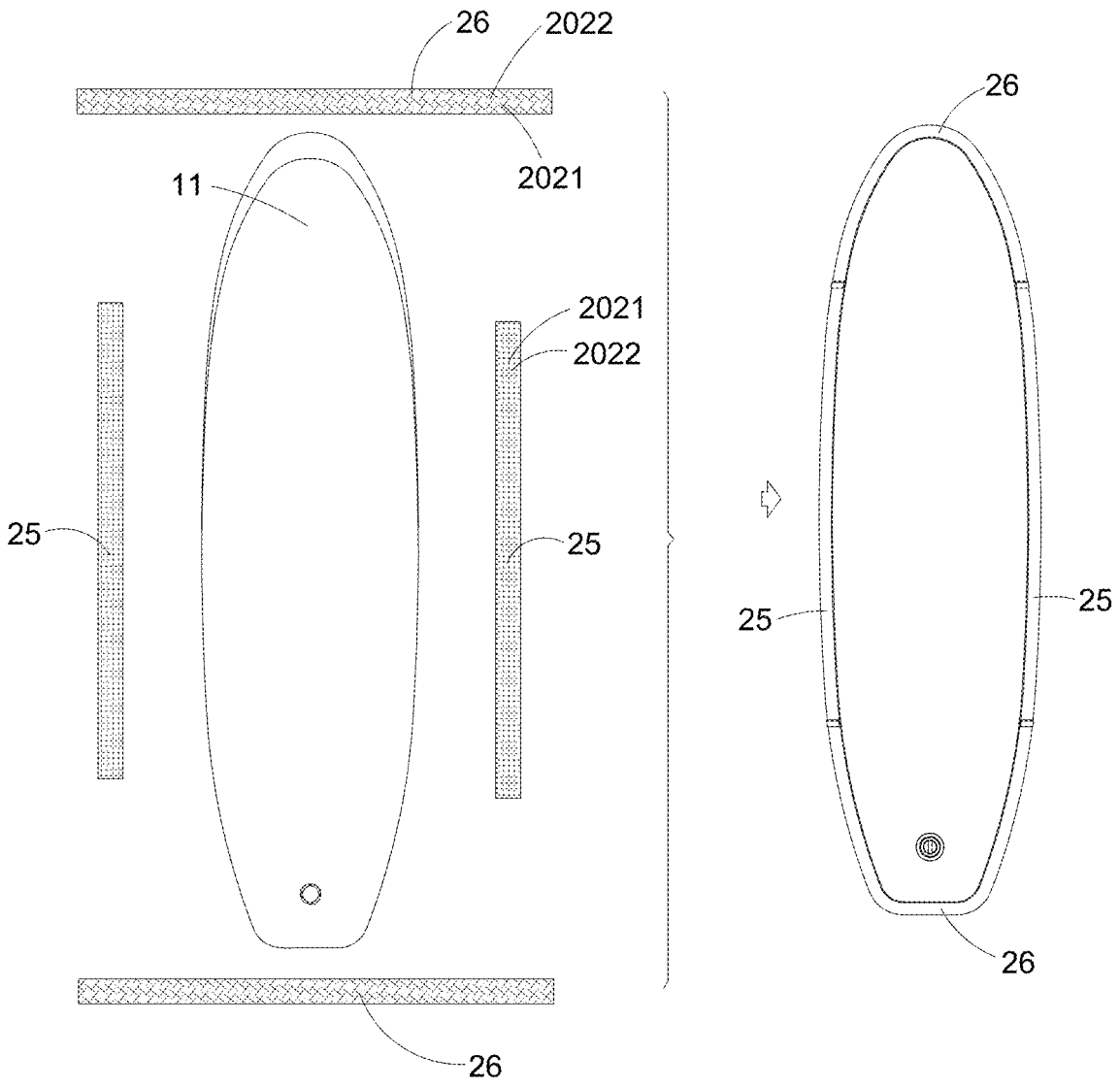
FIG. 3D is a schematic view illustrating an alternative side sealing strip of the inflatable paddle board according to the above preferred embodiment of the present invention.

As shown in FIG. 3D of the drawings, as an alternative mode, the side sealing strip 20 comprises two side sealing strip parts 25 and two end sealing strip parts 26 each is wrapped around edges of head portion 101 or tail portion 102 of the main body 10. Each of the side sealing strip parts 25 and the end sealing strip parts 26 comprises two surface layers 201 and a mesh layer 202 disposed between the two surface layers 201. The mesh layer 202 comprises a plurality of first yarns 2021 and a plurality of second yarns 2022 which are vertical to each other and are connected to define a plurality of connecting nodes 2023, the two surface layers 201 are coated on two sides of the mesh layer 202. The first yarns 2021 and the second yarns 2022 can be respectively embodied as warp yarns and weft yarns. The first yarns 2021 and second yarns 2022 of each side sealing strip part 25 can be horizontal and vertical yarns. The first yarns 2021 and second yarns 2022 of each end sealing strip part 26 can be inclined yarns, so as to allow for increased flexibility and stretchability, making it easier for the each end sealing strip part 26 to conform to the two sides of the head portion 101 or the tail portion 102 of the main body 10.

Figure 13:
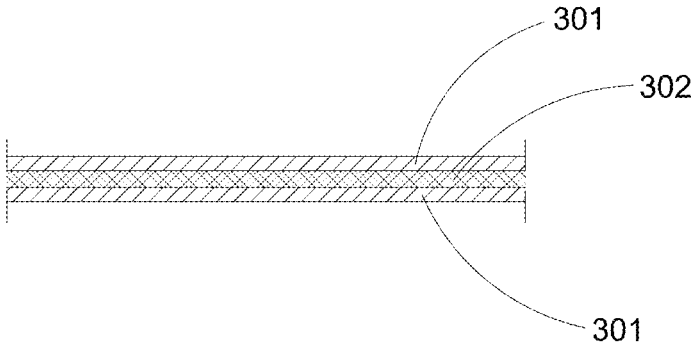
FIG. 13 is a sectional view illustrating the decoration strip of the inflatable paddle board according to the above preferred embodiment of the present invention.
Figure 14:
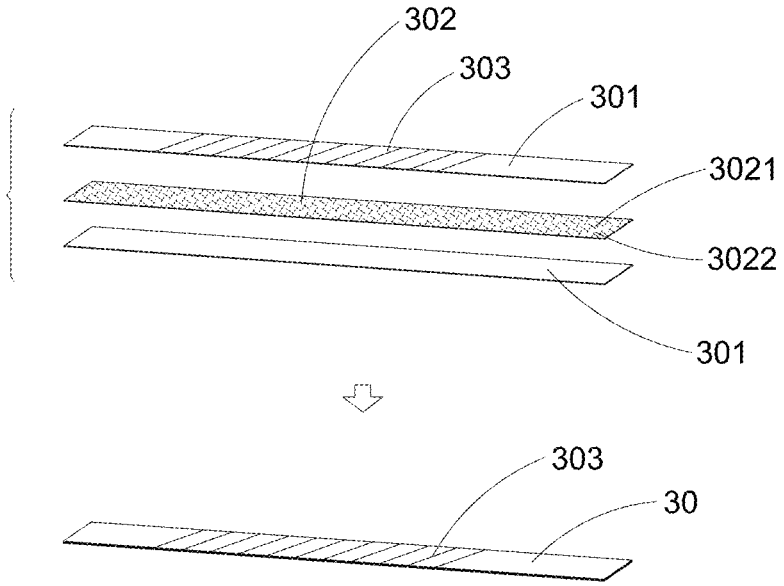
FIG. 14 is a schematic view illustrating the stacking of two surface layers and a mesh layer of the decoration strip of the inflatable paddle board according to the above preferred embodiment of the present invention.
Figure 15:
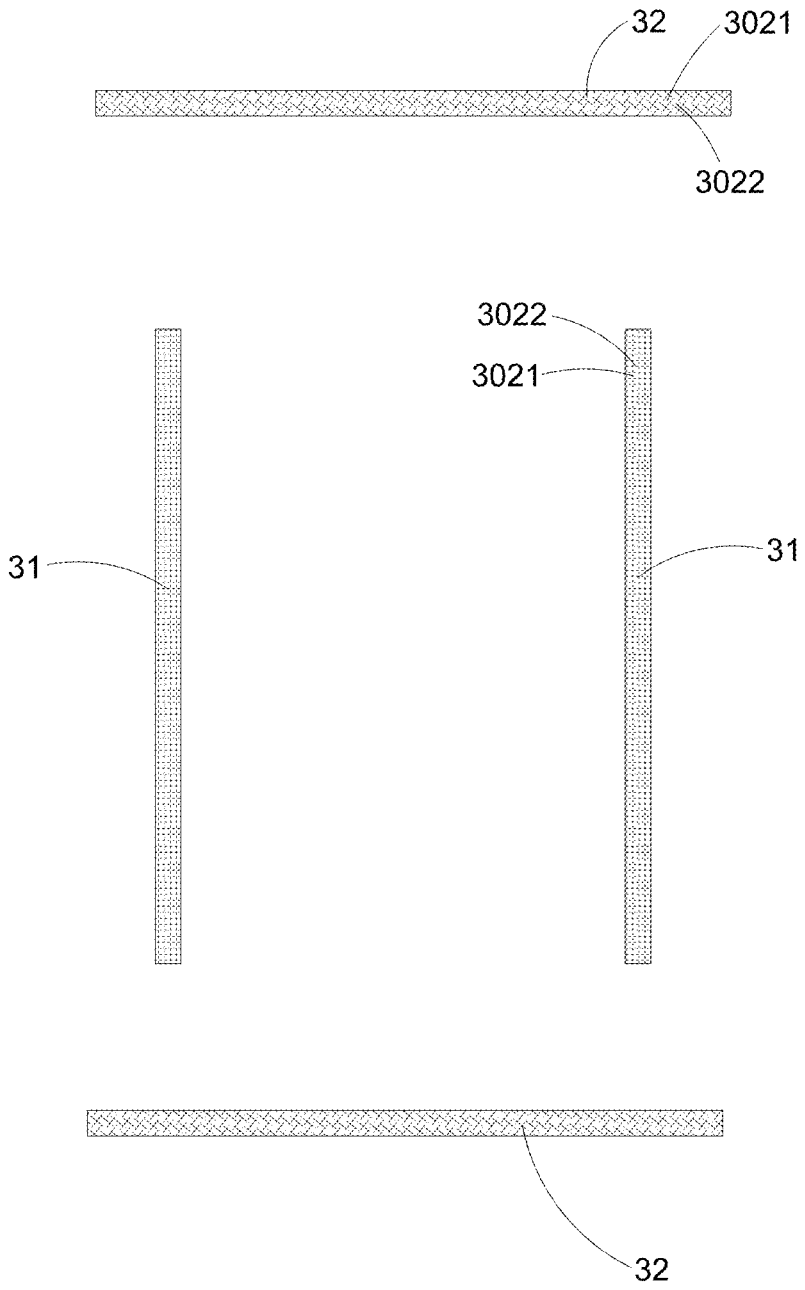
FIG. 15 is a schematic view illustrating the strip parts of the decoration strip of the inflatable paddle board according to the above preferred embodiment of the present invention, wherein a top surface layer above the mesh layer is removed for showing the mesh layer of each strip part.

In addition, as shown in FIGS. 13 to 15, the inflatable paddle board 100 may further comprise a decoration strip 30 which comprises two surface layers 301, a mesh layer 302 and a decoration pattern 303 painted on an outer surface layer of the two surface layers 301. The two surface layers 301 can be made of a same material as the two surface layers 201 of the side sealing strip 20, the mesh layer 302, which can be made of a same material as the mesh layer 202 of the side sealing strip 20, comprises first yarns 3021 and second yarns 3022. A weight density of the mesh layer 302 of the decoration strip 30 can be larger than a weight density of the mesh layer 202 of the peripheral enclosing strip 20. As an example, the mesh layer 302 of the decoration strip 30 can have a weight density of 1000D (Denier), the mesh layer 202 of the peripheral enclosing strip 20 can have a density of 500D. The stretchability and elasticity of the decoration strip 30 is thus reduced, but the rigidity and the strength of the decoration strip 30 is enhanced.

The decoration pattern enables custom branding and personalization, making the paddle board visually distinctive. It enhances product marketability by allowing brands to feature logos, color patterns, or promotional graphics. The decoration strip 30 also strengthens the side sealing strip 20, reinforcing the sidewalls of the inflatable paddle board 100. The mesh layer 302 improves tear resistance, preventing damage from external forces. By using the same materials as the side sealing strip 20, the decoration strip blends seamlessly into the structure of the inflatable paddle board 100, ensuring uniform performance without affecting flexibility.

In this embodiment, the decoration strip 30 can be glued to the side sealing strip 20, can be embodied as a single strip or comprises a plurality of strip parts that are connected to each other. As an example, the decoration strip 30 may comprise four strip parts including two side strip parts 31 and two end strip parts 32, the first yarns 3021 and the second yarns 3022 of each side strip part 31 can be inclined yarns, or the first yarns 3021 are horizontal yarns and the second yarns 3022 are vertical yarns. The first yarns 3021 and the second yarns 3022 of each end strip part 32 are inclined yarns, so as to conform to the contour of the bending edge of the main body 10.

Figure 4A:
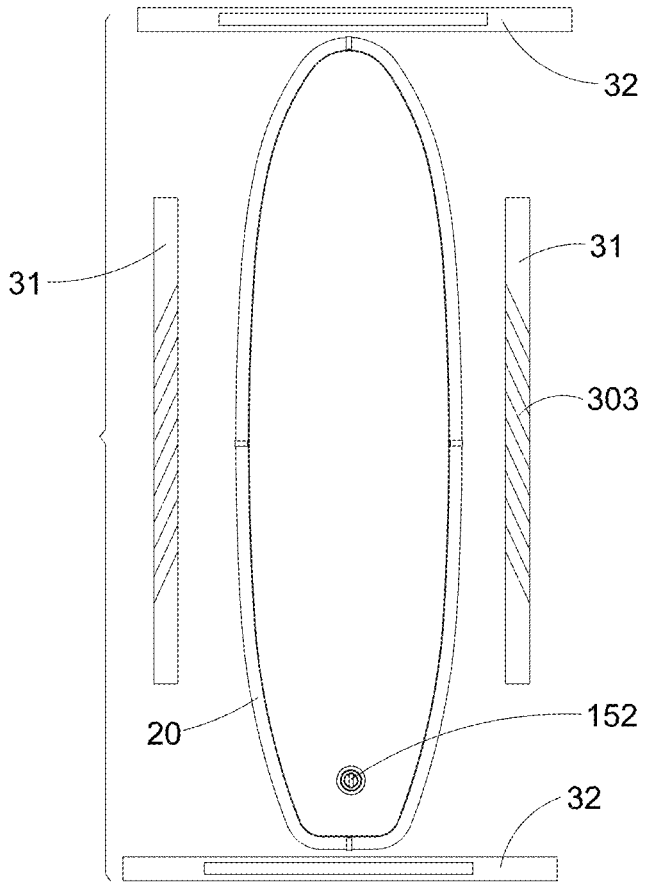
FIGS. 4A and 4B are schematic views illustrating the process of attaching the decoration strip on the side sealing strip of the inflatable paddle board according to the above preferred embodiment of the present invention.
Figure 4B:
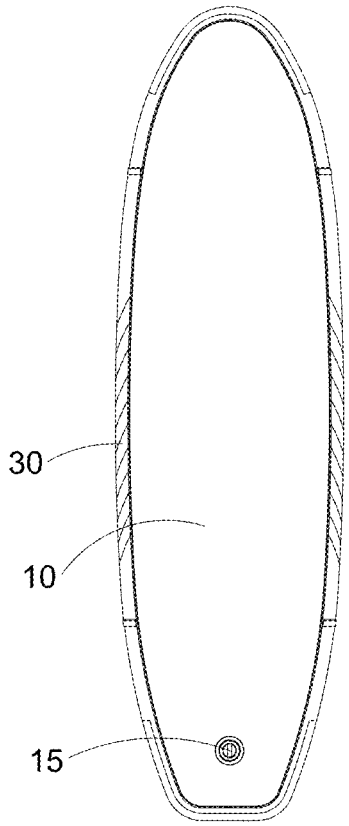
Figure 4C:
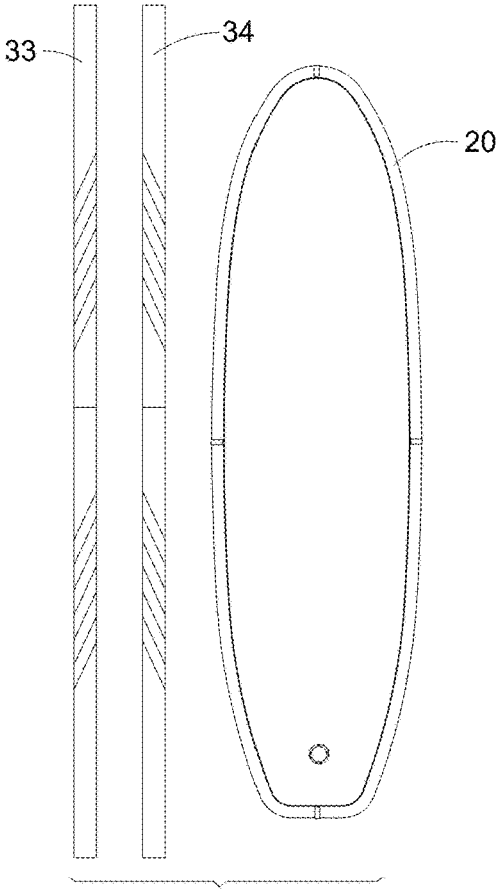
FIGS. 4C, 4D and 4E are schematic views illustrating the process of attaching an alternative decoration strip on the side sealing strip of the inflatable paddle board according to the above preferred embodiment of the present invention.
Figure 4D:
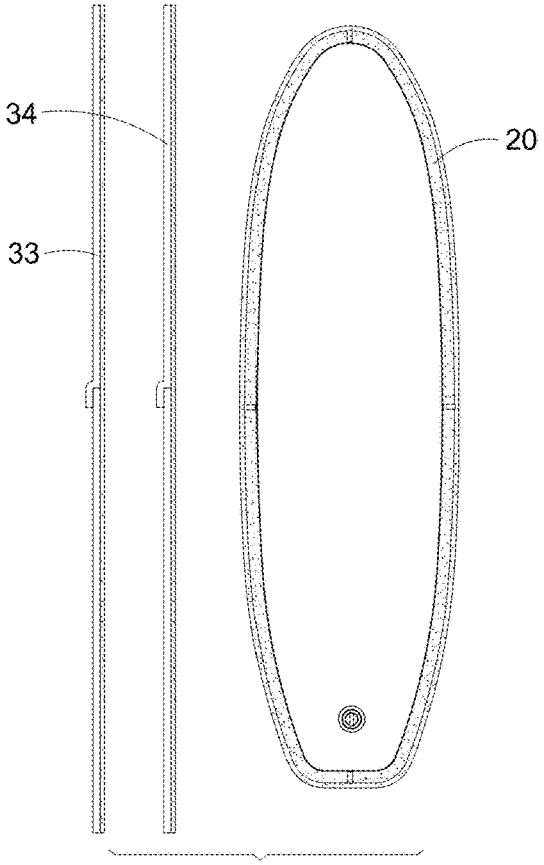
Figure 4E:
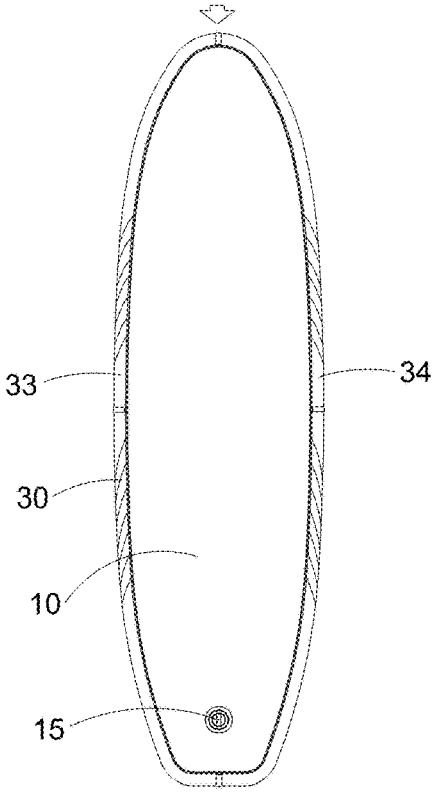

Referring to FIGS. 4C to 4E of the drawing, as an alternative mode, the decoration strip 30 comprises a first decoration strip body 33 and a second decoration strip body 34, each of the first decoration strip body 33 and the second decoration strip body 34 comprises two surface layers 301, a mesh layer 302 and a decoration pattern 303 painted on an outer surface layer of the two surface layers 301. The two surface layers 301 can be made of a same material as the two surface layers 201 of the side sealing strip 20, the mesh layer 302, which can be made of the same material as the mesh layer 202 of the side sealing strip 20, comprises first yarns 3021 and second yarns 3022.

The first decoration strip body 33 and the second decoration strip body 34 can be embodied to allow each of the head portion 101 and tail portion 102 of the main body 10 to be provided with mirrored yarn patterns at two sides thereof. In other words, the first yarns 2021 of the first decoration strip body 33 and the first yarns 2021 of the second decoration strip body 34 can be arranged in mirrored sloping lines at two sides of each of the head portion 101 and tail portion 102 of the main body 10, the second yarns 2022 of the first first decoration strip body 33 and the second yarns 2022 of the second decoration strip body 34 can be arranged in mirrored sloping lines at two sides of each of the head portion 101 and tail portion 102 of the main body 10. Each of the first decoration strip body 33 and the second decoration strip body 34 itself may have a same yarn pattern or two mirror yarn patterns on two parts thereof.

Alternatively, the peripheral enclosing strip 20 is omitted, and the decoration strip 30 with the plurality decoration strip parts having a larger thickness than the side sealing strip 20 can can be employed to wrap the edges of the main body 10.

It is worth mentioning that the inflatable paddle board 100 in an inflated state will comprise a raised head 1, also known as a rockered nose, which serves several functional purposes, primarily improving performance, stability, and usability in different water conditions. The raised head 1 helps the board ride over waves instead of cutting straight through them, reducing water resistance and preventing the nose from getting submerged. It improves control and maneuverability, especially in rough waters. A slightly lifted nose reduces the amount of water that directly contacts the front of the board, minimizing drag and allowing smoother movement. This is particularly beneficial for touring and racing paddle boards, helping them move efficiently over long distances.

In this embodiment, the raised head 1 is formed by the head portion 101 of the main body 10 and the part of the side sealing strip 20 bonded on the head portion 101, the top body layer 11 of the rest part 2 of the inflatable paddle board 100 has a horizontal top surface when the inflatable paddle board 100 has been inflated. The head portion 101 of the main body 10 is a portion with the bending edge 1011 and the head portion 101 comprises a top head layer 1012 and a bottom head layer 1013, a length L1 of the top head layer 1012 is smaller than a length L2 of the bottom head layer 1013, and the top head layer 1012 and the bottom head layer 1013 are adhered to the first strip part 21 and the second strip part 22 of the side sealing strip 20 by glue bonding, so that after the inflatable paddle board 100 is inflated, the raised head 1 is formed because of the length difference of the top head layer 1012 and a bottom head layer 1013.

Figure 18:
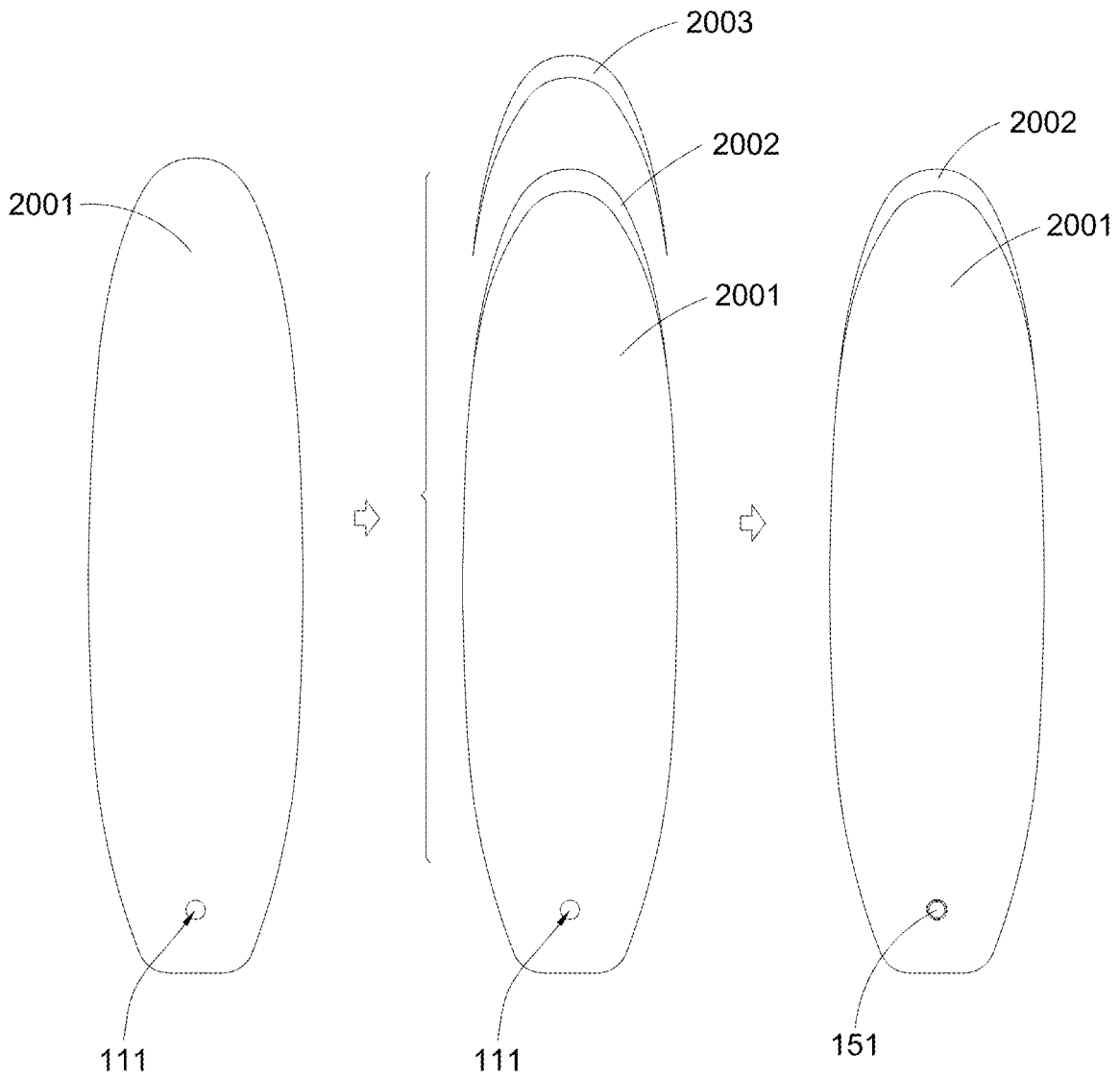
FIG. 18 is a schematic view illustrating the process of cutting a front end portion of a top material layer for forming a raised head of the inflatable paddle board according to the above preferred embodiment of the present invention.

Referring to FIG. 18 of the drawings, a top material layer 2001 and a bottom material layer 2002 are used to form the top body layer 11 and the bottom body layer 12 respectively. A front end portion 2003 of the top material layer 2001 is cut off, so as to provide the top body layer, the bottom material layer 2002 is used to provide the bottom body layer 12, so the length difference can be created between the top head layer 1012 and the bottom head layer 1013.

A length L of the raised head 1 which is a raised portion of the inflated paddle board 100 is about 60 cm-120 cm, a height of the raised head 1, which can be defined as a height h of a bottom edge of the side sealing strip 20 of the inflated inflatable paddle board 100, is about 3 cm-20 cm, preferred 5 cm-15 cm. A length of the front end portion 2003 of the top material layer 2001 being cut off can be 3 cm-7 cm.

Alternatively, when there is no length difference between the top body layer 11 and the bottom body layer 12, the raised head 1 is not formed in the inflatable paddle board 100.

Figure 19:
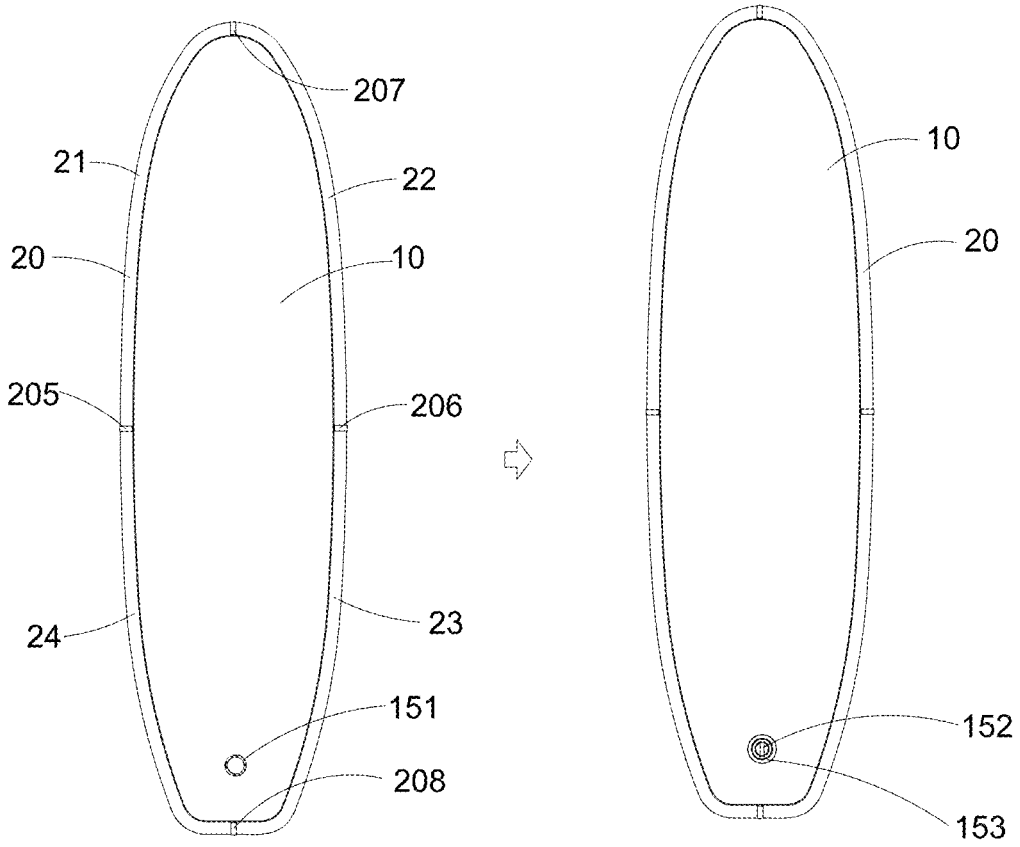
FIG. 19 is a schematic view illustrating a valve body being installed to the main body of the inflatable paddle board according to the above preferred embodiment of the present invention.

In addition, as shown in FIGS. 18 and 19, before the glue bonding process, a hole 111 is formed in the top body layer 11, a valve seat 151 of the inflation valve 15 can be disposed in the inflation chamber 14. After the glue bonding process, a valve body 152 can be mounted to the valve seat 151. In addition, one or more sealing layers can be disposed at the hole 111 for enhancing the sealing effect. An inner sealing layer, which can have a material configuration as the decoration strip 30, has a larger thickness for enhancing the cushioning effect. Two outer sealing layers 153, as shown in FIG. 19 of the drawings, which can have a material configuration as the peripheral enclosing strip 20 and have a smaller thickness can be disposed on the outer surface of the top body layer 11 between the valve body 152 and the top body layer 11, so as to prevent air leakage when the valve body 152 is mounted on the valve seat 151.

Figure 20:
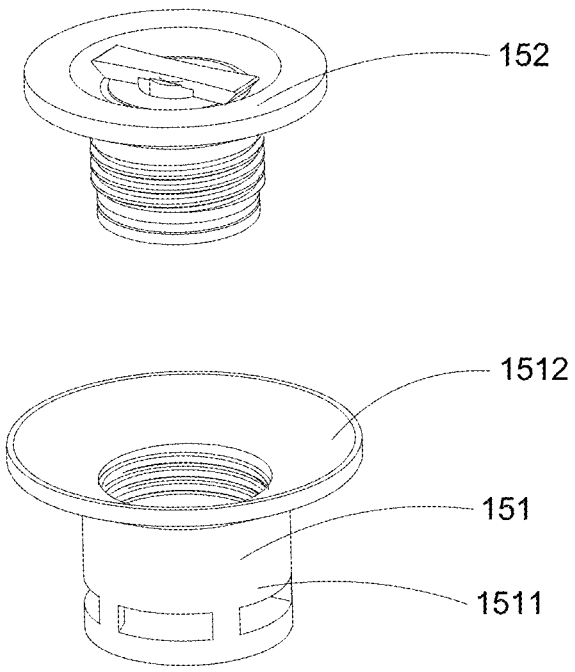
FIG. 20 is an exploded view illustrating an inflation valve of the inflatable paddle board according to the above preferred embodiment of the present invention

As shown in FIG. 20, the valve seat 151 comprises a seat body 1511 and a sealing ring body 1512 integrally extended from the seat body 1511, the valve body 152 can be screwed to the seat body 1511. A diameter of the sealing ring body 1512 is larger than a diameter of the hole 111 of the top body layer 11, so as to ensure the sealing effect. Before the glue bonding process of the peripheral enclosing strip 20, the valve seat 151 is placed into the space between the two body layers 11 and 12 from a side of the main body 10. After the glue bonding process of the side sealing strip 20, the valve body 152 is assembled on the valve seat 151 through the hole 111 of the top body layer 11.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. An inflatable paddle board, comprising:

a main body comprising two body layers; and a side sealing strip which is adhered to the two body layers to form an inflation chamber between the two body layers and the side sealing strip, wherein the side sealing strip comprises two surface layers and a mesh layer between the two surface layers, each mesh layer comprises a plurality of first yarns and a plurality of second yarns which are perpendicular to each other, wherein the plurality of first yarns and the plurality of second yarns of at least a part of the side sealing strip are respectively inclined with respect to a length direction of the side sealing strip.

2. The inflatable paddle board according to claim 1, wherein the side sealing strip comprises one or more strip parts which are wrapped around edges of the two body layers.

3. The inflatable paddle board according to claim 1, wherein the side sealing strip comprises a plurality of strip parts which are connected with each other.

4. The inflatable paddle board according to claim 3, wherein an inclined angle between the first yarns and the length direction of the side sealing strip is 30°-60°.

5. The inflatable paddle board according to claim 3, wherein an inclined angle between the first yarns and the length direction of the side sealing strip is 45°.

6. The inflatable paddle board according to claim 3, wherein the main body comprises a head portion and a tail portion, wherein each of the head portion and the tail portion are bonded with two strip parts which have different yarn patterns.

7. The inflatable paddle board according to claim 3, wherein the main body comprises a head portion and a tail portion, the first yarns of the two strip parts on two sides of each of the head portion and the tail portion are arranged in mirrored sloping lines, the second yarns of the two strip parts on two sides of each of the head portion and the tail portion are arranged in mirrored sloping lines.

8. The inflatable paddle board according to claim 7, wherein the main body comprises a plurality of connecting threads connected between the two body layers, wherein a width of a main portion of the side sealing strip between edges of the two body layers is smaller than a height of the connecting threads between the two body layers, wherein the connecting threads between edges of the two body layers are removed or cut off in the middle.

9. The inflatable paddle board according to claim 8, wherein the plurality of connecting threads form a plurality of triangular thread arrangements between the two body layers, each of the triangular thread arrangements comprises a first connecting thread and a second connecting thread, wherein the first connecting thread and the second connecting thread are connected to one of the two body layers at a same connecting point and are connected to the other of the two body layers at two different connecting points.

10. The inflatable paddle board according to claim 7, further comprising a decoration strip which is attached on the side sealing strip, the decoration strip comprises one or more strip parts each comprising a plurality of first yarns and a plurality of second yarns which are perpendicular to each other, wherein the first yarns and the second yarns in at least one of the strip parts are inclined yarns with respect to the length direction of the side sealing strip.

11. The inflatable paddle board according to claim 3, wherein the side sealing strip comprises two strip bodies wrapped around the edges of the main body, the two strip bodies have different yarn patterns.

12. The inflatable paddle board according to claim 3, wherein the side sealing strip comprises two strip bodies wrapped around the edges of the main body, the first yarns of the two strip bodies on two sides of the main body are arranged in mirrored sloping lines, the second yarns of the two strip bodies on two sides of the main body are arranged in mirrored sloping lines.

13. The inflatable paddle board according to claim 1, wherein the main body comprises a head portion and a tail portion, wherein the side sealing strip comprises two side sealing strip parts and two end sealing strip parts which are respectively glued to the head portion and the tail portion of the main body, wherein the plurality of first yarns and the plurality of second yarns of each end sealing strip part are respectively inclined with respect to the length direction of the side sealing strip.

14. The inflatable paddle board according to claim 1, wherein the main body comprises a plurality of connecting threads connected between the two body layers, wherein a width of a main portion of the side sealing strip between edges of the two body layers is smaller than a height of the connecting threads, wherein the connecting threads between edges of the two body layers are removed or cut off in the middle.

15. The inflatable paddle board according to claim 14, wherein the plurality of connecting threads form a plurality of triangular thread arrangements between the two body layers, each of the triangular thread arrangements comprises a first connecting thread and a second connecting thread, wherein the first connecting thread and the second connecting thread are connected to one of the two body layers at a same connecting point and are connected to the other of the two body layers at two different connecting points.

16. The inflatable paddle board according to claim 1, further comprising a decoration strip which is attached on the side sealing strip, the decoration strip comprises one or more strip parts each comprising a plurality of first yarns and a plurality of second yarns which are perpendicular to each other, wherein the first yarns and the second yarns in at least one of the strip parts are inclined yarns with respect to the length direction of the side sealing strip.

17. The inflatable paddle board according to claim 16, wherein the decoration strip comprises two side strip parts and two end strip parts each connected between the two side strip parts, the first yarns and the second yarns in each end strip part are inclined yarns with respect to the length direction of the side sealing strip.

18. The inflatable paddle board according to claim 16, wherein the decoration strip comprises a first decoration strip body and a second decoration strip body which are respectively attached on two opposite sides of the side sealing strip, wherein the first decoration strip body and the second decoration strip body comprise mirrored yarn patterns.

19. The inflatable paddle board according to claim 1, wherein the two body layers are PVC or TPU drop stitch fabrics, wherein a plurality of connecting threads are connected between the two body layers.

20. The inflatable paddle board according to claim 19, wherein each surface layer of the side sealing strip is made of PVC or TPU, the mesh layer is made of a fiber material selected from the group consisting of polyester terylene fiber, nylon and aramid fiber.

* * * * *